US009803956B2

(12) United States Patent
Ellingson

(10) Patent No.: US 9,803,956 B2
(45) Date of Patent: Oct. 31, 2017

(54) ELECTRONIC TABLET CASE AND FIREARM HOLDER

(71) Applicant: iPackin Holding LLC, Stuart, FL (US)

(72) Inventor: Blaine V. Ellingson, Jenson Beach, FL (US)

(73) Assignee: iPackin Holding LLC, Stuart, FL (US)

( * ) Notice: Subject to any disclaimer, the term of this patent is extended or adjusted under 35 U.S.C. 154(b) by 221 days.

(21) Appl. No.: 14/748,302

(22) Filed: Jun. 24, 2015

(65) Prior Publication Data

US 2016/0084614 A1 Mar. 24, 2016

Related U.S. Application Data

(60) Provisional application No. 62/016,313, filed on Jun. 24, 2014.

(51) Int. Cl.

| | |
|---|---|
| ***A45C 11/00*** | (2006.01) |
| ***F41C 33/06*** | (2006.01) |
| ***A45C 11/24*** | (2006.01) |
| ***F41C 33/04*** | (2006.01) |
| *A45C 13/02* | (2006.01) |

(52) U.S. Cl.

CPC ..... *F41C 33/06* (2013.01); *A45C 11/00* (2013.01); *A45C 11/24* (2013.01); *F41C 33/048* (2013.01); *A45C 2011/003* (2013.01); *A45C 2013/026* (2013.01); *A45C 2200/15* (2013.01)

(58) Field of Classification Search

USPC ..... 206/45.2, 45.23, 45.24, 320, 576, 701, 206/722, 723

See application file for complete search history.

(56) References Cited

U.S. PATENT DOCUMENTS

| | | | | |
|---|---|---|---|---|
| 3,589,062 | A | 6/1971 | Desmond et al. | |
| 5,170,919 | A | 12/1992 | DeSantis et al. | |
| 5,170,919 | B1 | 12/1992 | DeSantis et al. | |
| 5,294,031 | A | 3/1994 | Volpei et al. | |
| 5,374,919 | A | 12/1994 | Zelka et al. | |
| 5,495,967 | A | 3/1996 | Parton | |
| 5,584,424 | A | 12/1996 | Stava | |
| 5,662,219 | A | 9/1997 | Tschudy et al. | |
| 5,671,830 | A | 9/1997 | Wood | |
| 5,924,565 | A | 7/1999 | COlee | |
| 5,967,393 | A | 10/1999 | Clarke, III | |
| 6,135,277 | A * | 10/2000 | Armstrong | A45C 13/02 206/314 |
| 8,074,477 | B1 | 12/2011 | Weiche | |
| 8,297,440 | B2 * | 10/2012 | Schmidt | F16M 11/10 206/320 |
| 2004/0149605 | A1 * | 8/2004 | Ohtaki | H04B 1/3822 206/320 |
| 2007/0000965 | A1 | 1/2007 | Cannon, Jr. | |
| 2008/0047860 | A1 | 2/2008 | Shane | |

(Continued)

*Primary Examiner* — Jacob K Ackun

(74) *Attorney, Agent, or Firm* — McHale & Slavin, P.A.

(57) ABSTRACT

Disclosed is an electronic tablet case capable of concealing a firearm. The case is formed from a housing having closeable panels that are hingedly connected, defining an interior and exterior. The exterior of one of the panels includes mounting elements for securing to an electronic tablet. The interior of one panel includes at least one support element for holding a firearm in position. The panels can be secured together by use of a zipper, hook & loop or the like fastener.

9 Claims, 71 Drawing Sheets

(56) References Cited

U.S. PATENT DOCUMENTS

| | | | | |
|---|---|---|---|---|
| 2009/0205985 | A1* | 8/2009 | Freeman | A45C 3/02<br>206/320 |
| 2010/0025446 | A1 | 2/2010 | Eberle | |
| 2010/0065454 | A1* | 3/2010 | Badillo | A45C 9/00<br>206/320 |
| 2011/0290837 | A1 | 12/2011 | Smith | |
| 2012/0180302 | A1* | 7/2012 | Lopez, Jr. | A47B 96/027<br>29/525.01 |
| 2013/0258573 | A1* | 10/2013 | Muday | G06F 1/1613<br>361/679.21 |
| 2014/0095915 | A1* | 4/2014 | Hitchcock | G06F 1/3212<br>713/323 |

* cited by examiner

ELECTRONIC TABLET CASE AND FIREARM HOLDER

RELATED APPLICATIONS

In accordance with 37 C.F.R. 1.76, a claim of priority is included in an Application Data Sheet filed concurrently herewith. Accordingly, the present invention claims priority to U.S. Provisional Patent Application No. 62/016,313, entitled "Electronic Tablet Case and Firearm Holder", filed Jun. 24, 2014. The contents of the above referenced application is incorporated in its entirety.

FIELD OF THE INVENTION

This invention relates generally to cases for carrying a firearm and, more specifically, to a device for concealing a firearm within an electronic tablet case.

DESCRIPTION OF THE PRIOR ART

Firearms are used for personal protection. To be effective, firearms must be readily accessible and are commonly found in waist belts and shoulder holsters worn by law enforcement officers. Many off-duty officers do not wish to publicly display firearms, and numerous states have now enacted concealed weapon permits that allow permitted citizens to carry a concealed firearm. This has led to an increase in the sale of firearms as violent crimes continue to exist.

It can be problematic for a citizen to carry a firearm in a conventional waist or shoulder holster. Open display of a firearm, even by an off duty officer, can invoke an undesired confrontation. For this reason, a number of prior art references are directed to the carrying of a firearm in an auxiliary or disguisable case. U.S. Pat. No. 3,589,062 discloses a guitar having a hinged door for placement of a firearm. U.S. Pat. No. 5,170,919 discloses a belt to be worn around an individual's waist, the belt having a carrying pouch for placement of a firearm. U.S. Pat. No. 5,294,031 discloses a fanny pack having a compartment for placement of a firearm. U.S. Pat. No. 5,374,919 discloses a pack body that is worn about an individual's waist and includes a compartment for concealing a firearm. U.S. Pat. No. 5,495,967 discloses a carrier having a quick release access for placement of a firearm. U.S. Pat. No. 5,584,424 discloses a pouch for securement of a firearm; the pouch appears to be a cellular telephone case. U.S. Pat. No. 5,662,219 discloses a case shaped to resemble an organizer for placement of a firearm. U.S. Pat. No. 5,671,830 discloses a briefcase with a hidden compartment for placement of a firearm. U.S. Pat. No. 5,924,565 discloses a zippered article case for placement of a firearm. U.S. Pat. No. 5,967,393 discloses a carrying case that has the appearance of a portable phone/radio with a hidden compartment for placement of a firearm. U.S. Pat. No. 8,074,477 discloses a storage device for quick access to a firearm. U.S. Patent Publication No. 2007/0000965 discloses a case for placement of a firearm, the case having sub-panels allowing the case to be used for storing various items in addition to the firearm. U.S. Patent Publication No. 2008/0047860 discloses a briefcase that operates as a ballistic shield and a firearm holder. U.S. Patent Publication No. 2010/0025446 discloses a backpack for placement of a firearm. U.S. Patent Publication No. 2011/0290837 discloses a rack lock frame for attachment to a motorcycle and placement of a firearm.

What is lacking in the art is a case for concealing a firearm that is inconspicuous in business environments.

SUMMARY OF THE INVENTION

Disclosed is an electronic tablet case capable of concealing a firearm. The case is formed from a housing having closeable panels that are hingedly connected, defining an interior and exterior. The exterior of one of the panels includes mounting elements for securing to an electronic tablet. The interior of one panel includes at least one support element for holding a firearm in position. The panels can be secured together by use of a zipper, hook & loop, mechanical or electronic latch or the like fastener. The mounting element may consist of hook & loop fasteners or include a bracket attachment for use with or without a cover panel to protect the tablet. Where a cover panel is employed, openings for charger access, volume access, microphone access, speaker access, fingerprint identification, and power switch access are contemplated. In addition, an aperture sized to reveal an electronic tablet logo can be positioned, such as that to disclose the IPAD Apple® logo. The result is a case that looks like an IPAD case but provides a concealed and readily accessible firearm.

It is an objective of the instant invention to provide a firearm case that does not attract attention.

It is a further objective of the instant invention to provide a firearm case disguised as an electronic tablet holder.

It is a further objective of the present invention to provide a firearm case that makes the weapon available for immediate access.

Another objective of the present invention is to provide a firearm case that can carry one of a variety of different sized hand guns concealed inside.

Still another objective of this invention is to provide a case that is handy, inconspicuous and acceptable in most any environment.

It is yet another objective of this invention to provide an apparatus that, when closed, functions as an electronic tablet case and can unobtrusively conceal a weapon inside.

It is a further objective of this invention to provide adjustable fasteners to maintain the firearm and any accessory in a secure position within the case.

It is a still further objective of this invention to provide a case that enables the firearm to be extracted quickly. Other objectives and further advantages and benefits associated with this invention will be apparent to those skilled in the art from the description, examples and claims which follow.

DETAILED DESCRIPTION

Figure 1:
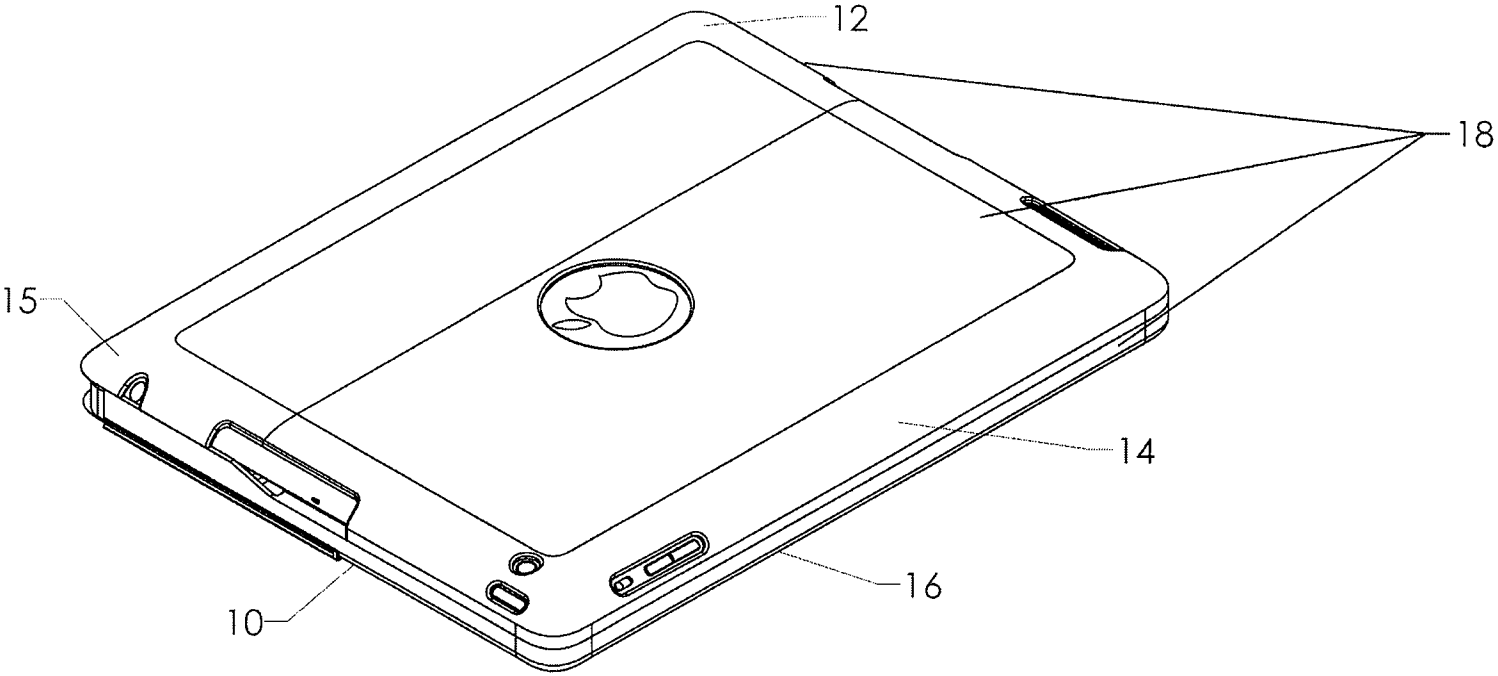
FIG. 1 is a perspective view of an IPAD used in a first embodiment construction.
Figure 2A:
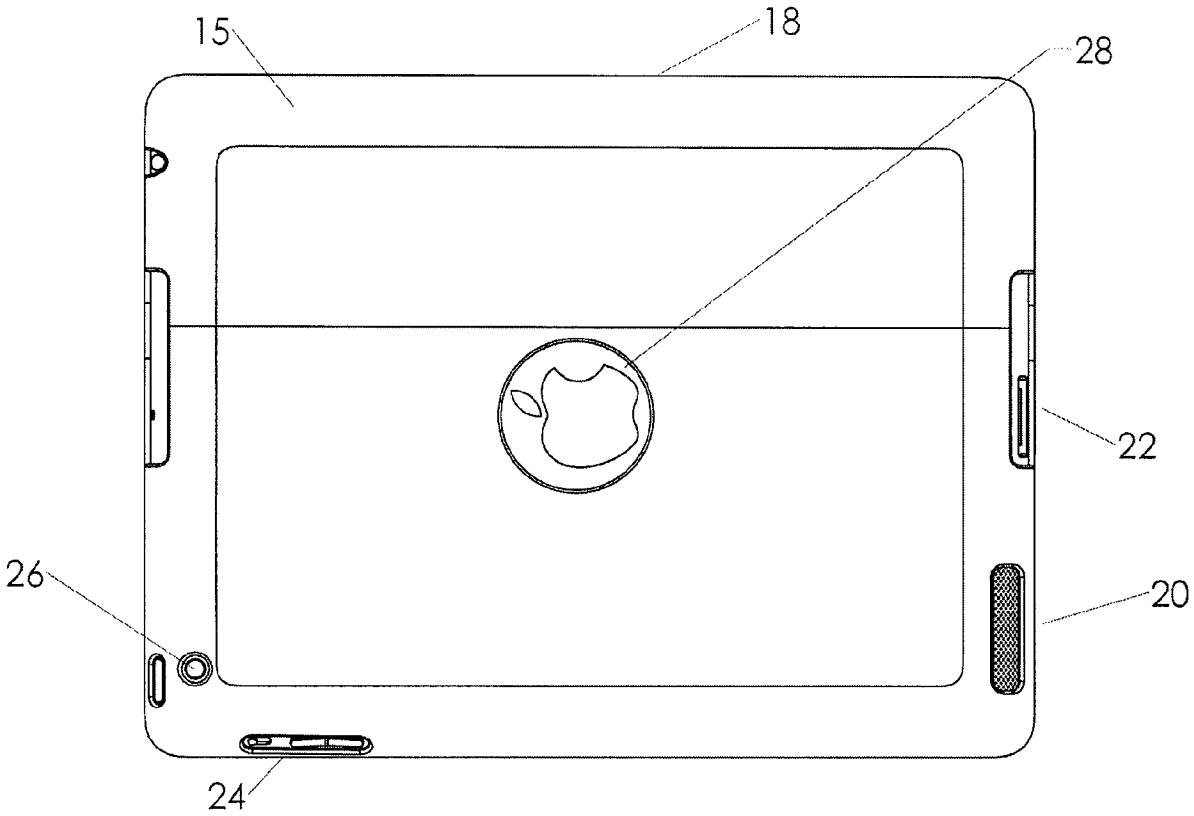
FIG. 2A is a top view of FIG. 1.
Figure 2B:
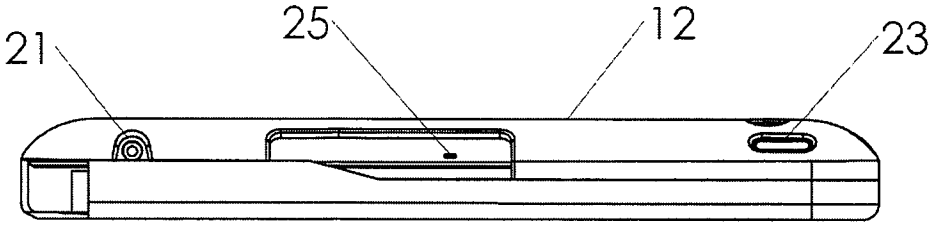
FIG. 2B is a left side view of FIG. 1.
Figure 2C:
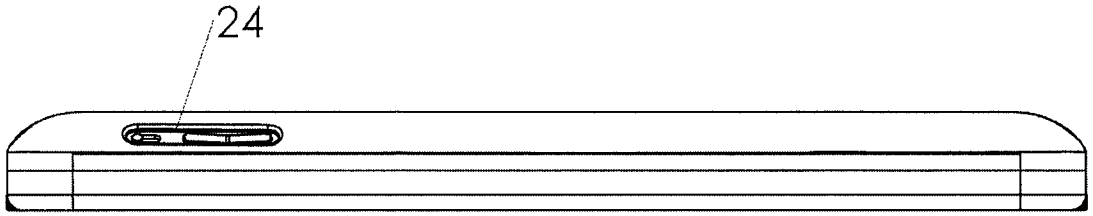
FIG. 2C is a top side view of FIG. 1.
Figure 2D:
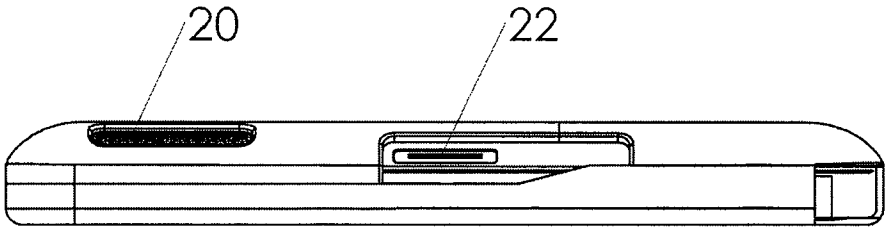
FIG. 2D is a right side view of FIG. 1.
Figure 3:
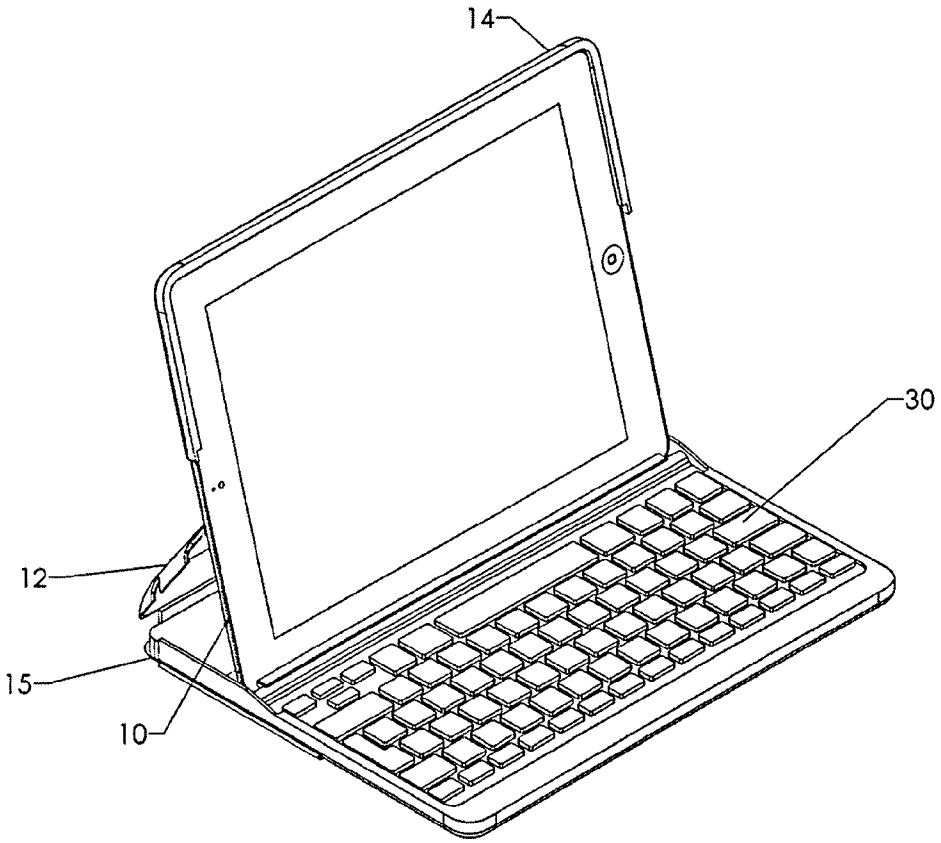
FIG. 3 is a perspective view of FIG. 1 in an open position.
Figure 4A:
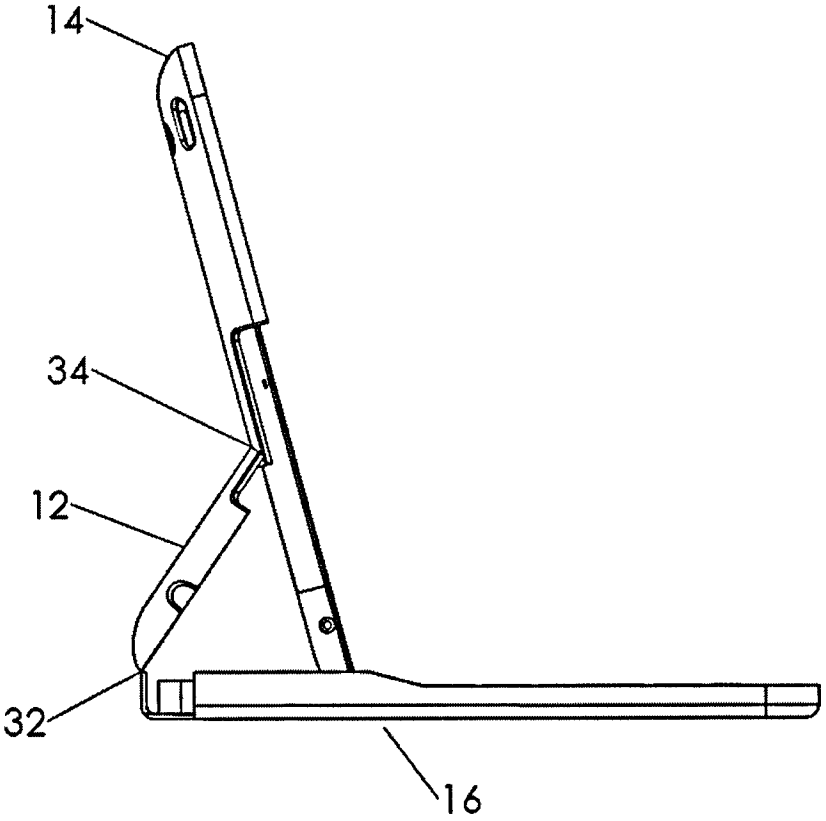
FIG. 4A is a left side view of FIG. 3.
Figure 4B:
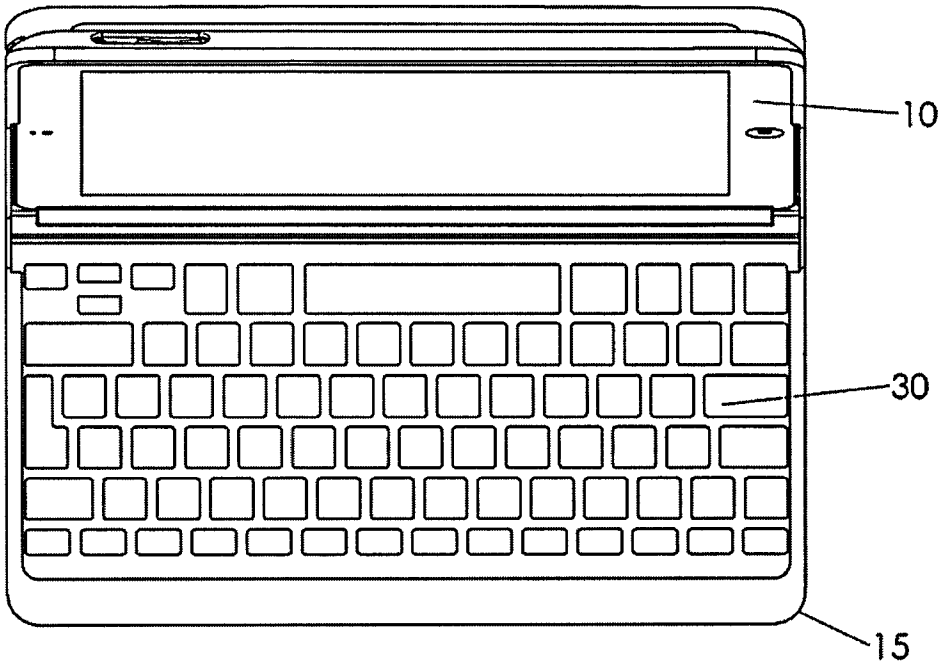
FIG. 4B is a top view of FIG. 3.
Figure 4C:
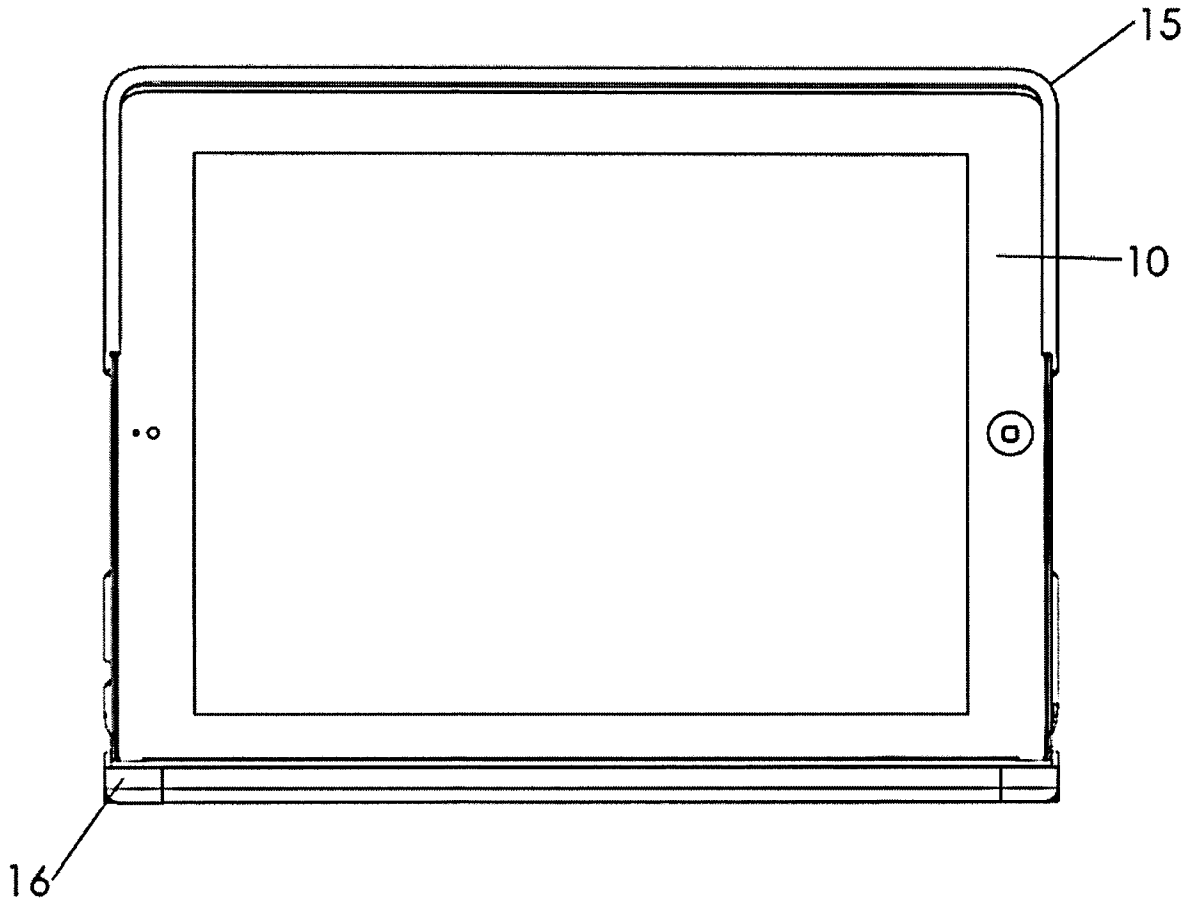
FIG. 4C is a front view of FIG. 3.
Figure 4D:
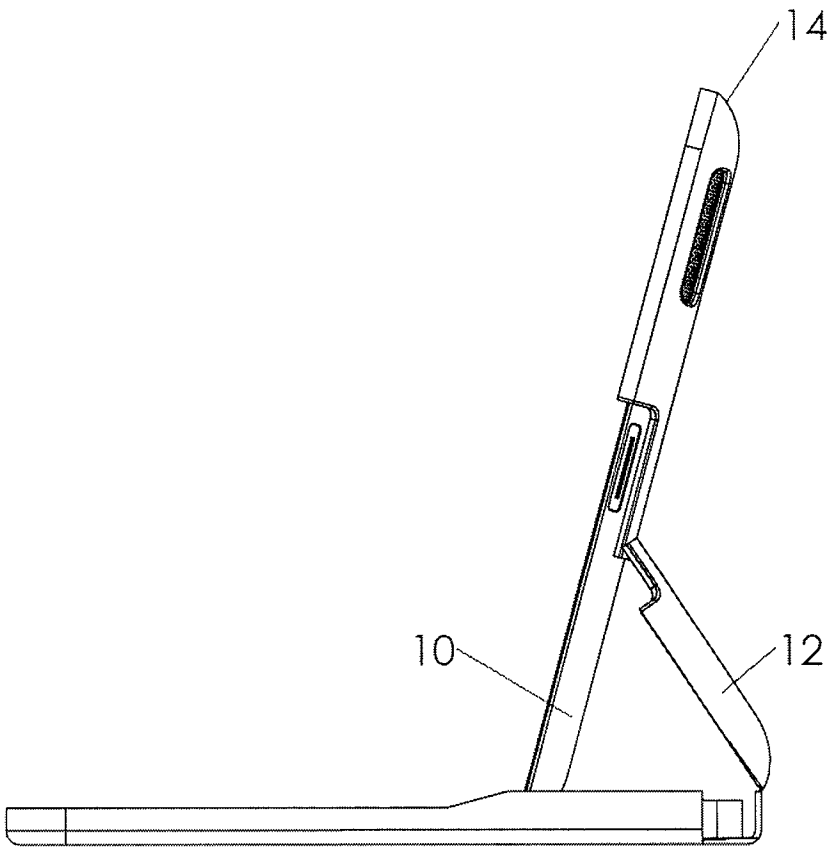
FIG. 4D is a right side view of FIG. 3.
Figure 5A:
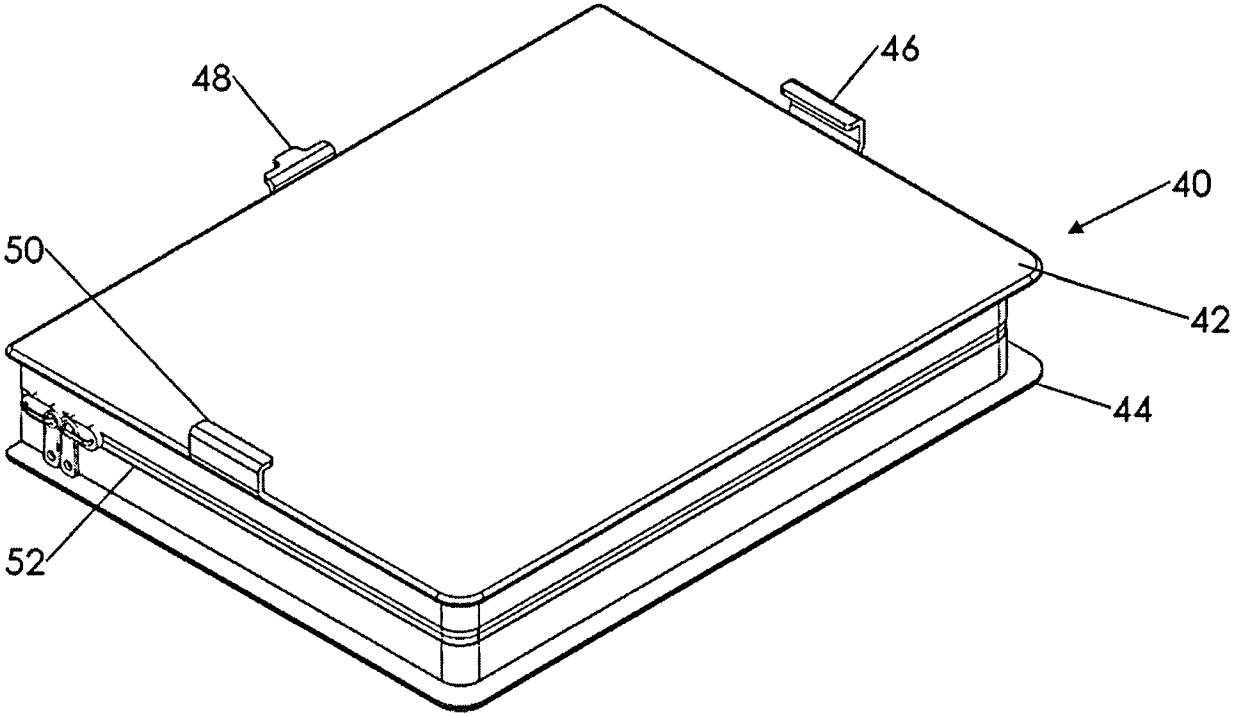
FIG. 5A is a perspective view of a case used in the first embodiment construction.
Figure 5B:
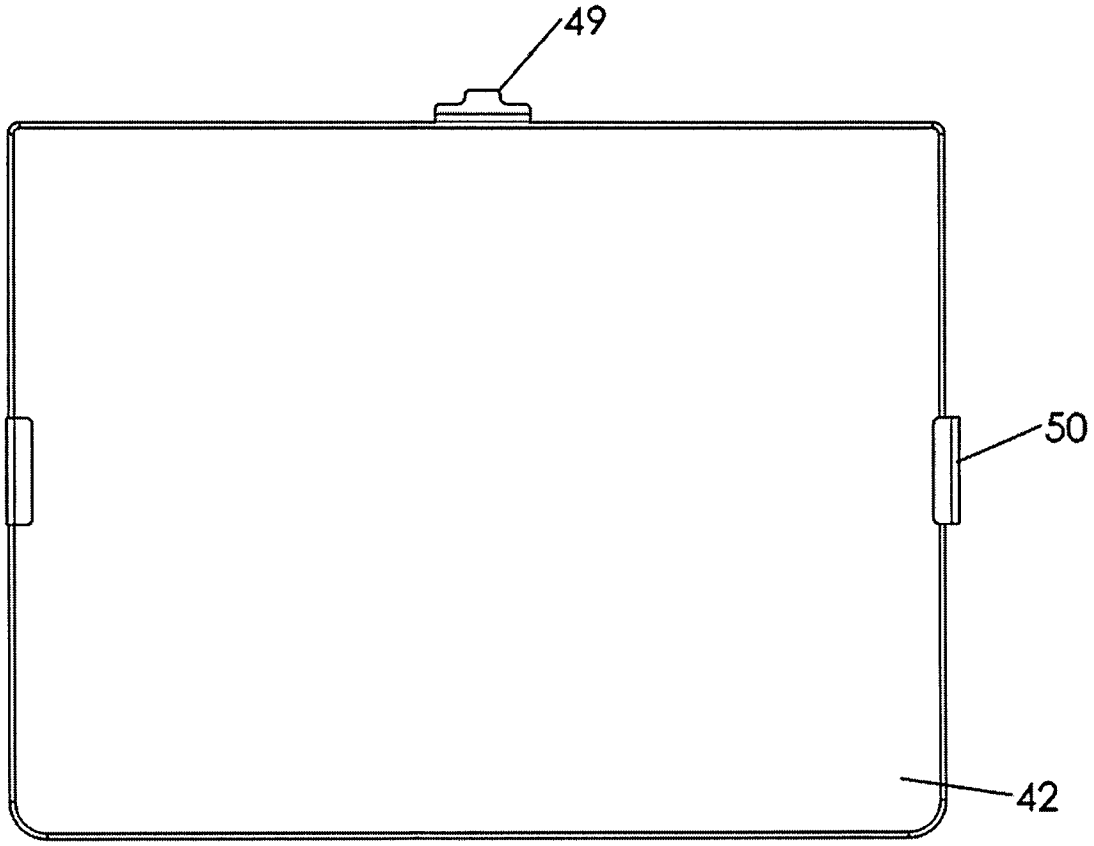
FIG. 5B is a top view of the embodiment illustrated in FIG. 5A.
Figures 5C, 5F:
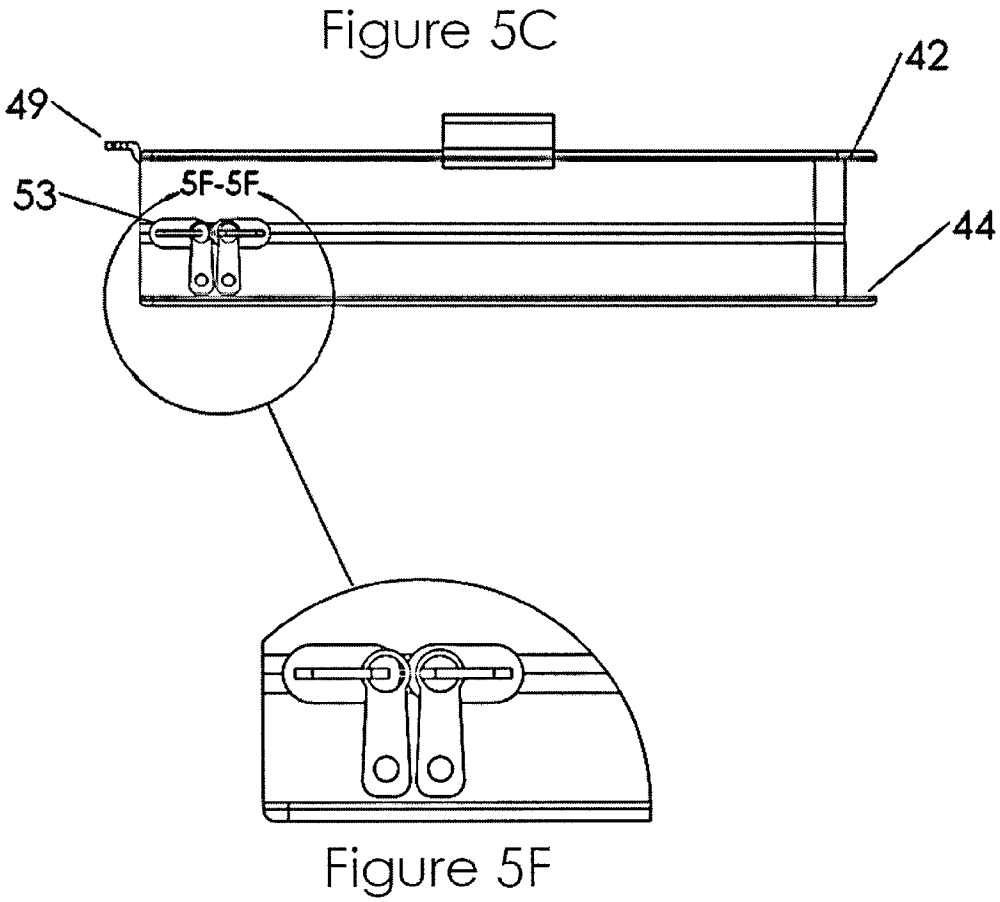
FIG. 5C is a left side view of the embodiment illustrated in FIG. 5A.
FIG. 5F is a section view taken along lines 5F-5F of FIG. 5C.
Figures 5D, 5G:
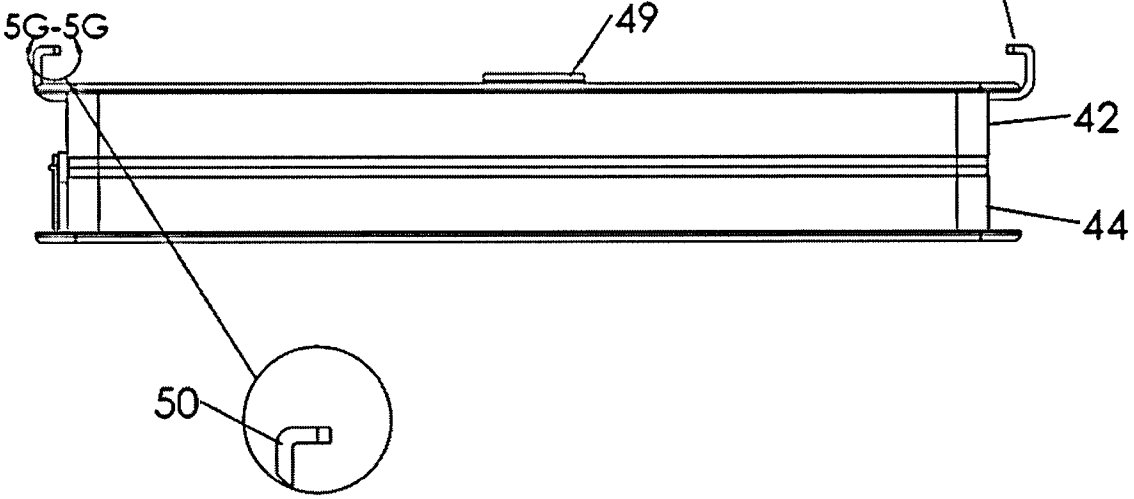
FIG. 5D is a front view of the embodiment illustrated in FIG. 5A.
FIG. 5G is a section view taken along lines 5G-5G of FIG. 5D.
Figure 5E:
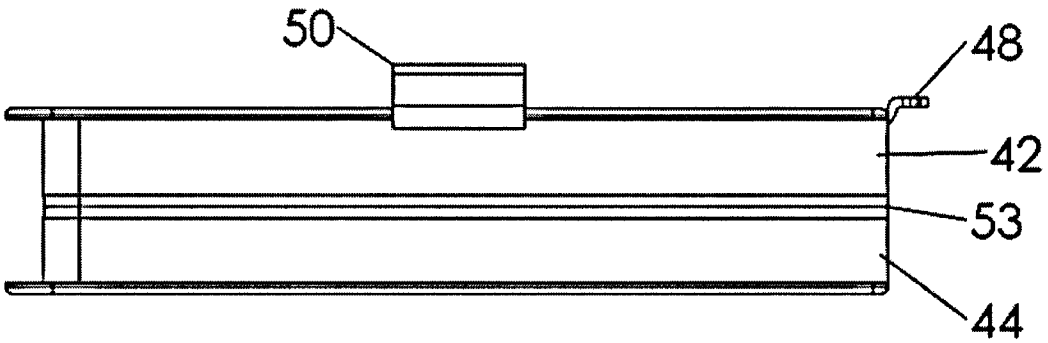
FIG. 5E is a right side view of the embodiment illustrated in FIG. 5A.

Detailed embodiments of the instant invention are disclosed herein; however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Referring now to FIGS. 1, 2A, 2B, 2C and 2D, set forth is a first embodiment depicting a closed IPAD case 15, having a segmented, three-piece shell consisting of a rear portion 12, a frontal portion 14 and a bottom portion 16, connected with a flexible outer skin operating as a living hinge to allow for opening and concealment of the IPAD 10. The shell 18 includes access ports for a speaker 20, speaker jack 21, IPAD charger 22, volume access 24, power button access 23, microphone access 25, and camera access 26. Typical of APPLE is placement of a logo within the middle of the case, and an aperture window 28 is provided so that the logo can be readily viewed.

Referring now to FIGS. 3, 4A, 4B, 4C, and 4D, set forth is an open IPAD 10 with the IPAD case 15 folded back with the rear portion 12 providing support, the frontal portion 14 adhering to the top of the IPAD 10, and a removable keyboard 30 revealed once the IPAD has been lifted. A rear section 12, frontal section 14 and bottom section 16 are further illustrated in FIG. 4A with hinge points 32 and 34, which operate as a living hinge for positioning of the IPAD in an upright position.

Referring to FIGS. 5A, 5B, 5C, 5D, 5E, 5F and 5G, depicting the storage case 40 having a first closable panel 42 hingedly secured to a second closable panel 44. The exterior of the first panel 42 includes mounting elements 46, 48 and 50, which operate as a latch to secure the aforementioned IPAD 10 to the first panel 42. The mounting elements 46, 48 and 50 are constructed and arranged to engage the bottom section 16 (FIGS. 3 and 4A), which allows for ease of removal if the IPAD is to be separated from the case 40. The mounting elements 46-50, in the preferred embodiment, are flexible rails having a C-shape. The C-shape allows the rails to flex sufficiently to snap over a portion of the IPAD 10 or IPAD case 15. In another embodiment the rails slide into a track provided along the side of the IPAD case. The release latch 49 is also flexible and snaps over a rear portion of the IPAD case 15 to provide three point containment and location for the IPAD. The first 42 and second 44 closable panels can be sealed together by use of a zipper 52 which covers three sides of the case, sealing the interior of the case when the zipper is in a closed position, or allowing access to the interior of the case when the zipper is in an open position. Hinge 53 allows the case to be opened and closed as desired by the user. In the preferred embodiment the hinge is a living hinge. However, any type of hinge known in the art may be utilized without departing from the scope of the invention. It should be noted that most any type of fastener can be used in place of a zipper, including snaps, hook and loop, magnets and the like. It should also be noted that while an IPAD case 15 is illustrated as including the bottom portion 16 for attachment to the case 40, the bottom portion may be omitted or built into the first panel 42 of the case to provide a low profile embodiment (not shown) without departing from the scope of the invention.

Figures 6A, 6B:
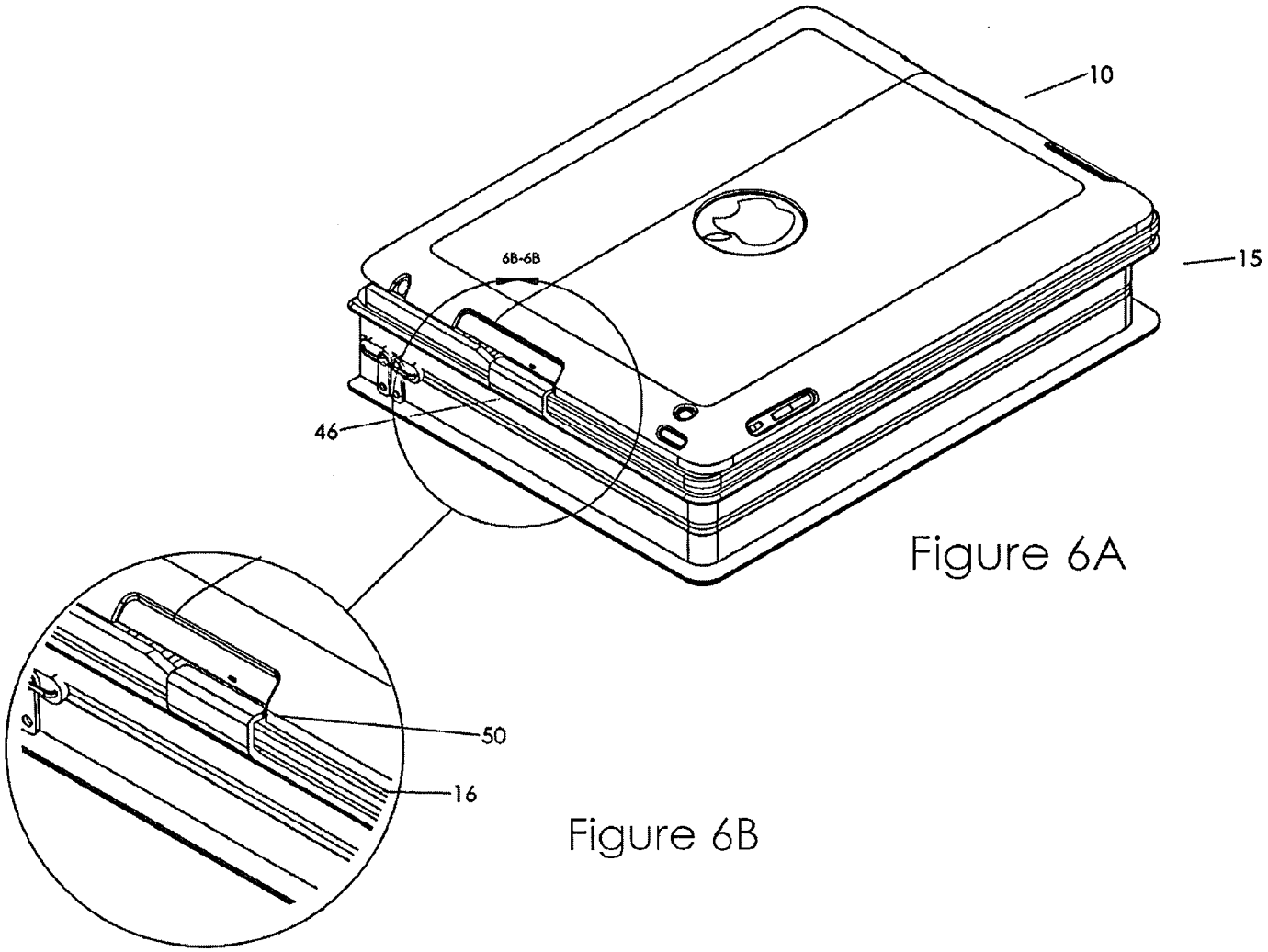
FIG. 6A is a perspective view of the IPAD and case of the first embodiment.
FIG. 6B is a section view taken along lines 6B-6B of FIG. 6A.
Figure 6C:
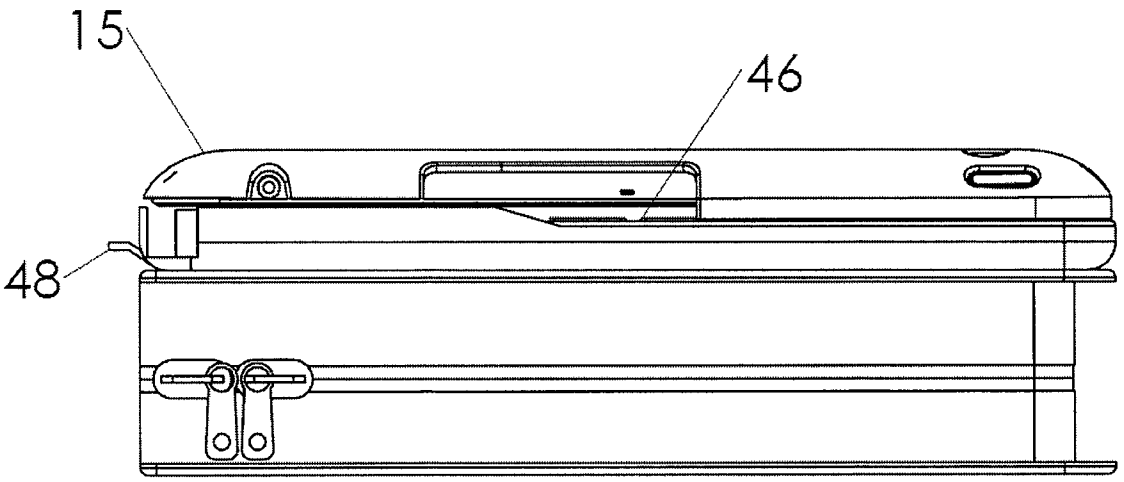
FIG. 6C is a left side view of the embodiment illustrated in FIG. 6A.
Figure 6D:
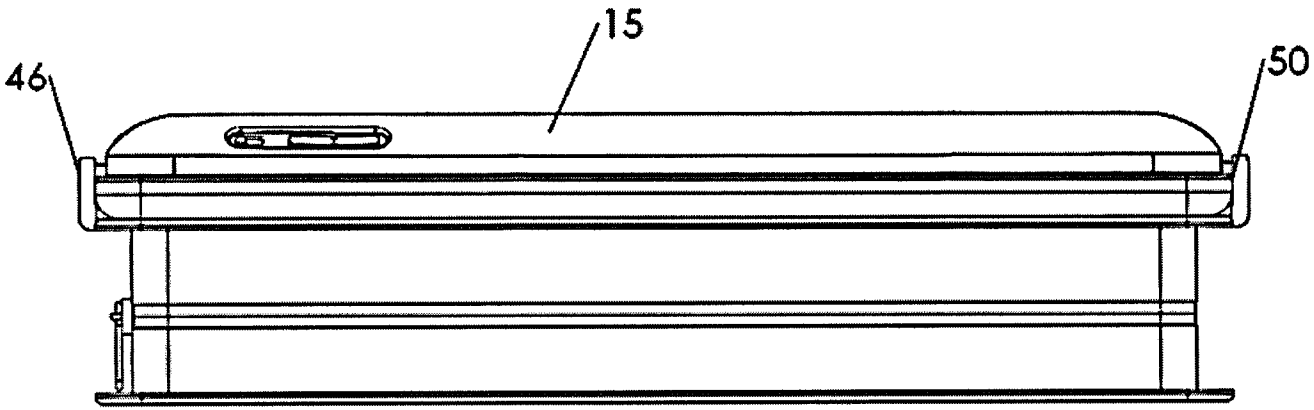
FIG. 6D is a front view of the embodiment illustrated in FIG. 6A.
Figure 6G:
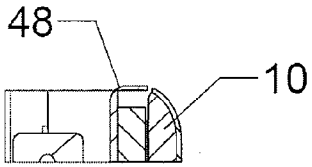
FIG. 6G is a section view taken along lines 6G-6G of FIG. 6E.
Figure 6F:
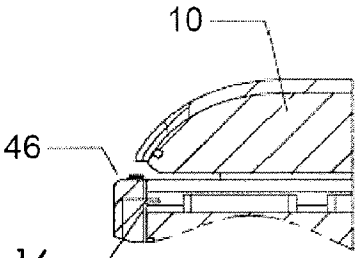
FIG. 6F is a section view taken along lines 6F-6F of FIG. 6E.
Figure 6E:
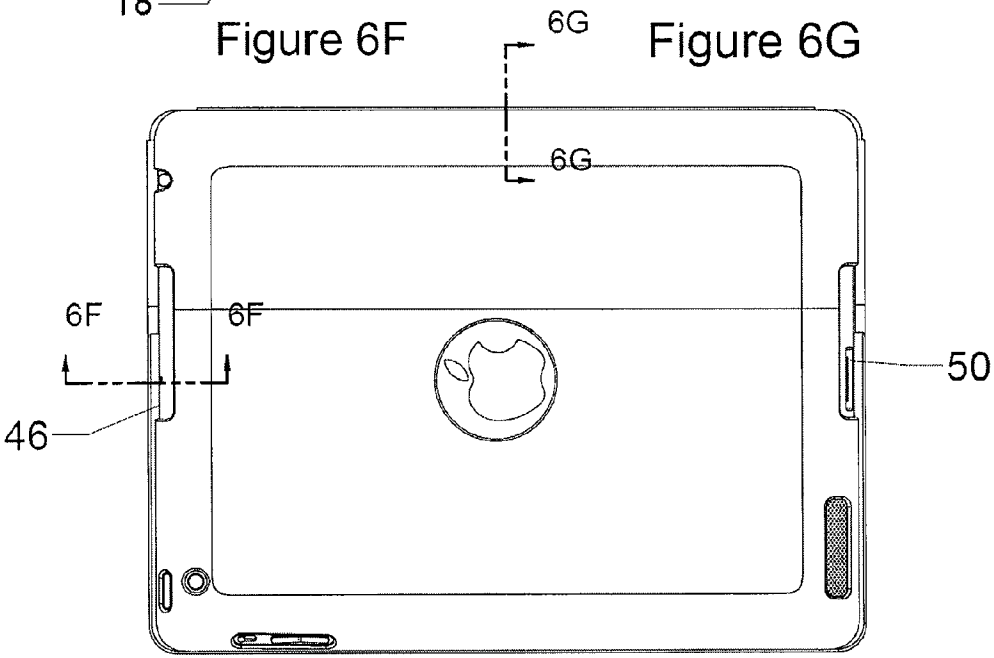
FIG. 6E is a top view of the embodiment illustrated in FIG. 6A.
Figure 7A:
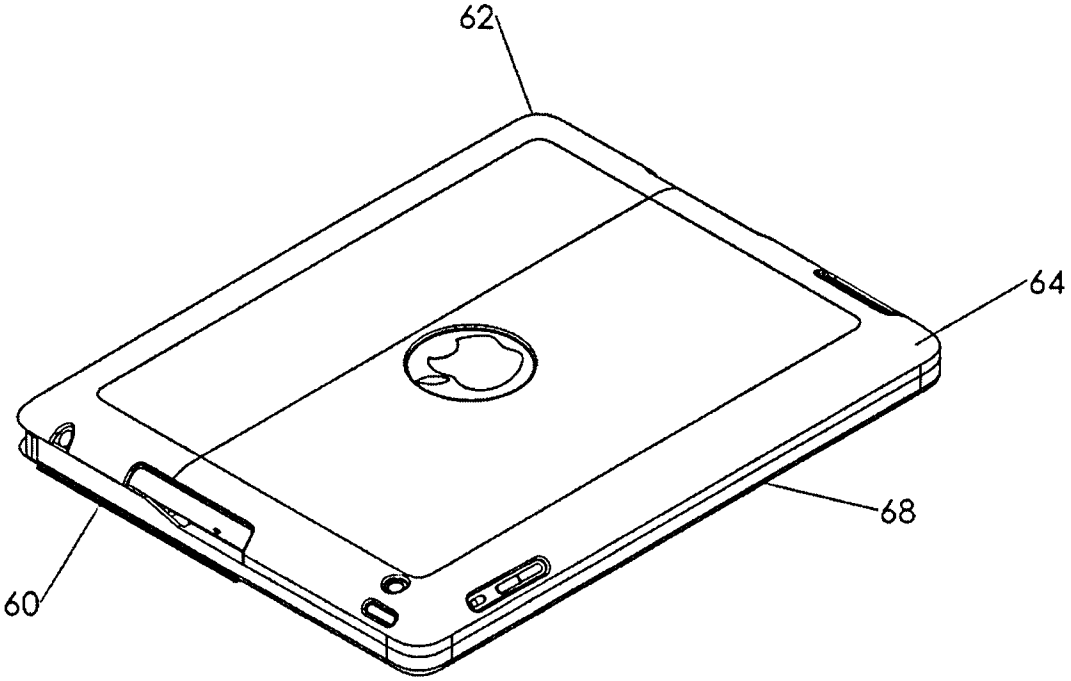
FIG. 7A is a perspective view of an IPAD used in a second embodiment construction.
Figure 7B:
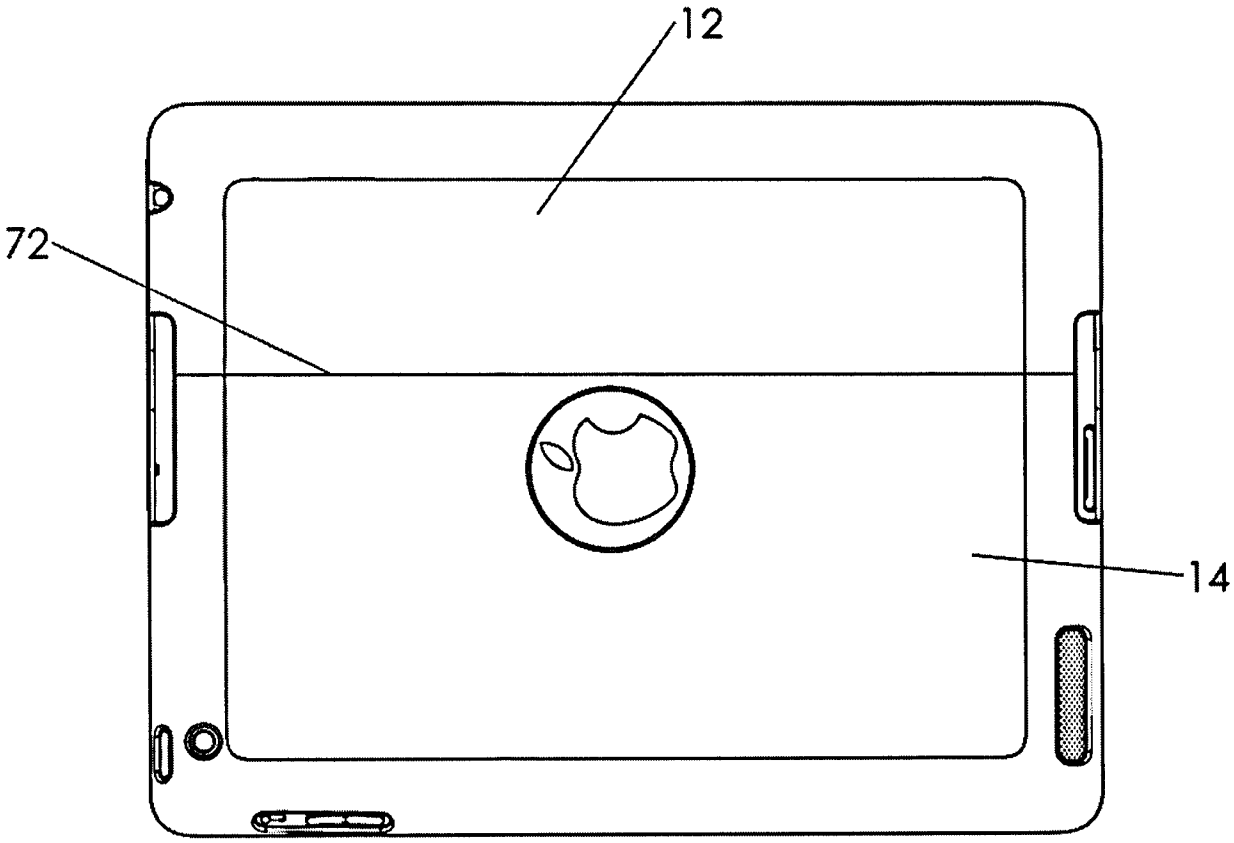
FIG. 7B is a top view of the embodiment illustrated in FIG. 7A.
Figure 7C:
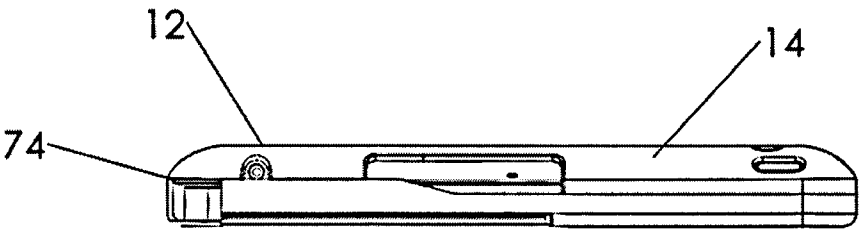
FIG. 7C is a left side view of the embodiment illustrated in FIG. 7A.
Figure 7D:
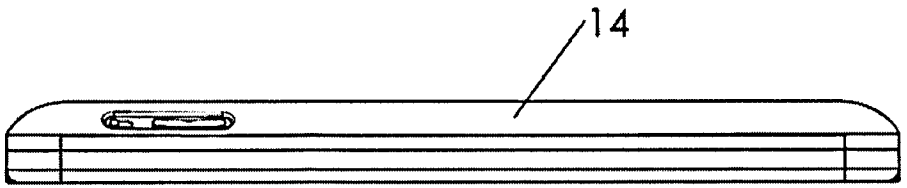
FIG. 7D is a front view of the embodiment illustrated in FIG. 7A.
Figure 7E:
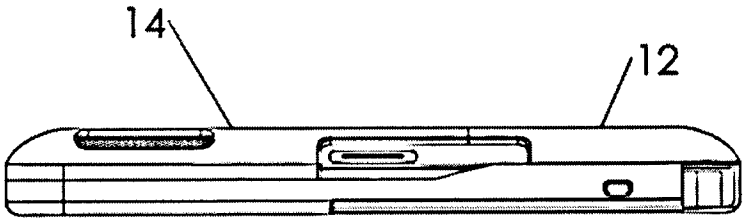
FIG. 7E is a right side view of the embodiment illustrated in FIG. 7A.
Figure 8A:
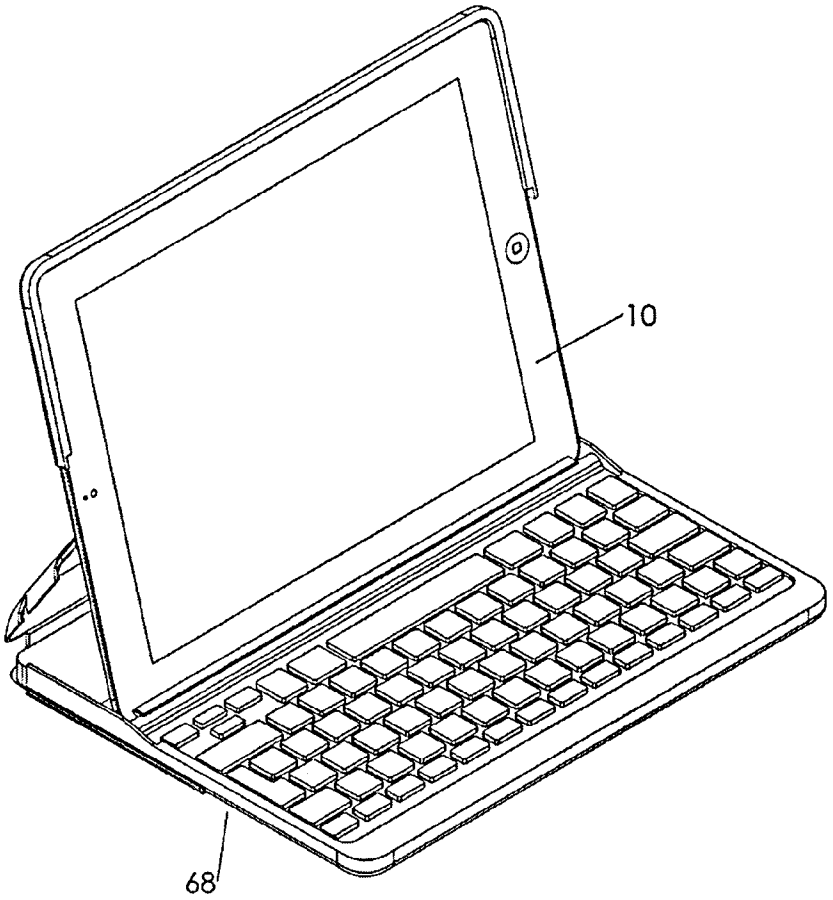
FIG. 8A is a perspective view of the IPAD of FIG. 7 in an open position.
Figure 8B:
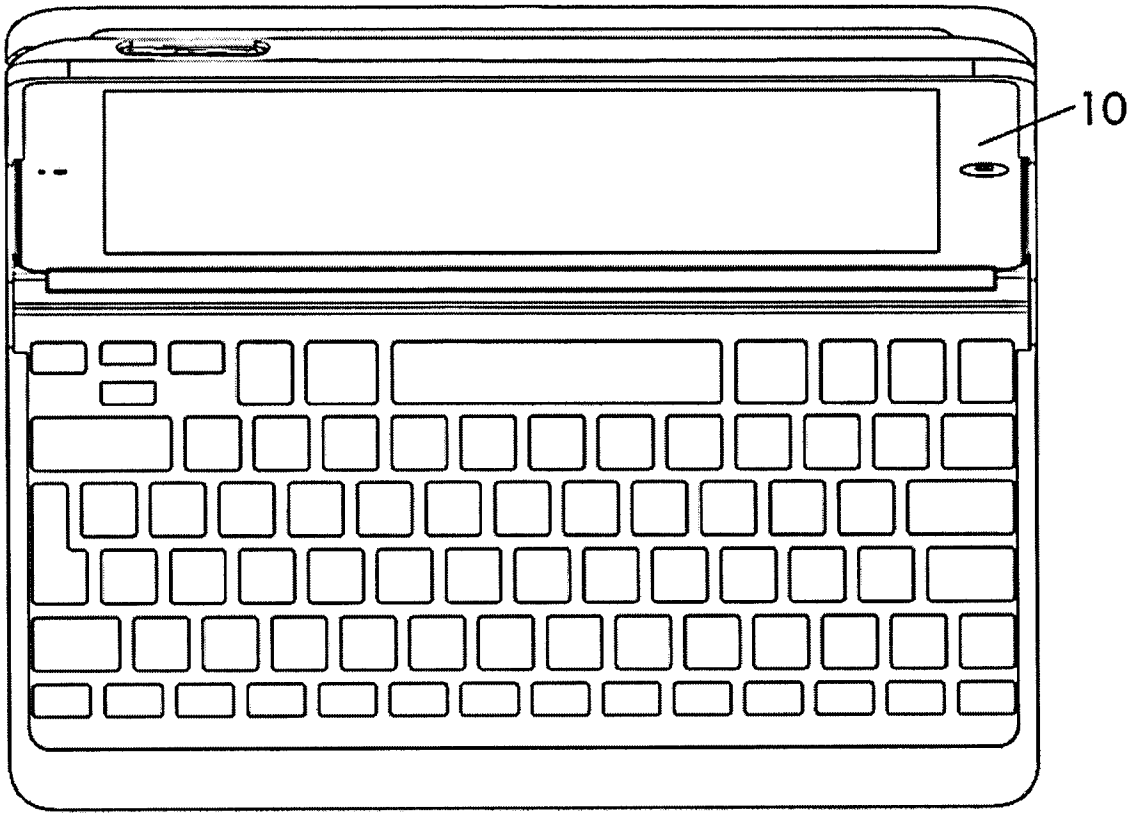
FIG. 8B is a top view of the embodiment illustrated in FIG. 8A.
Figure 8C:
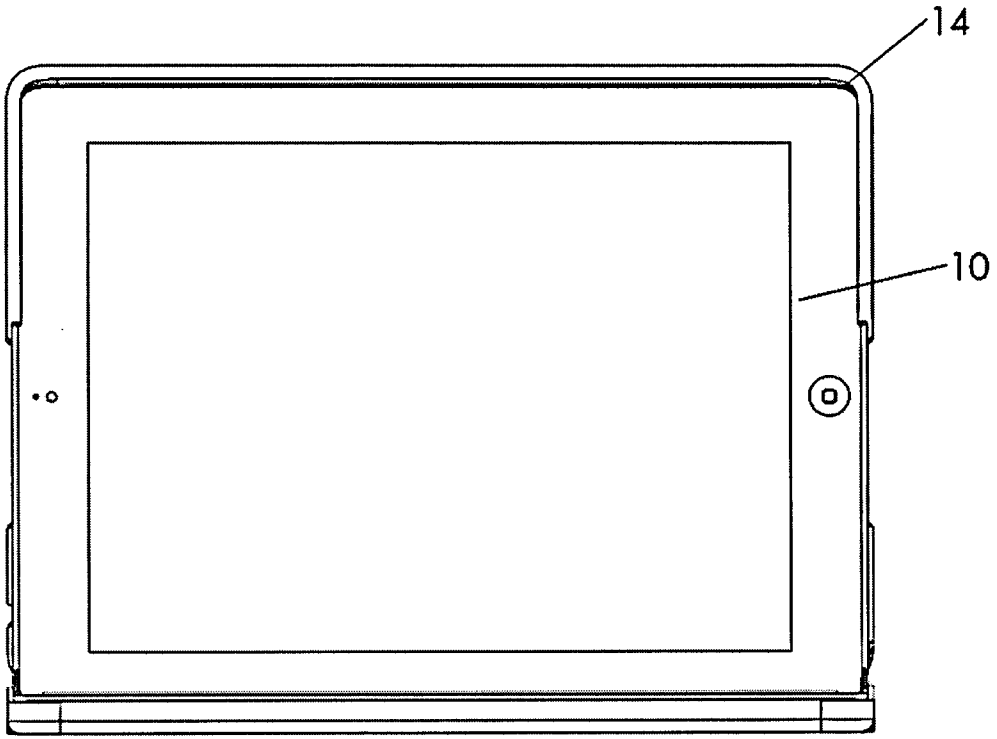
FIG. 8C is a front view of the embodiment illustrated in FIG. 8A.
Figure 8D:
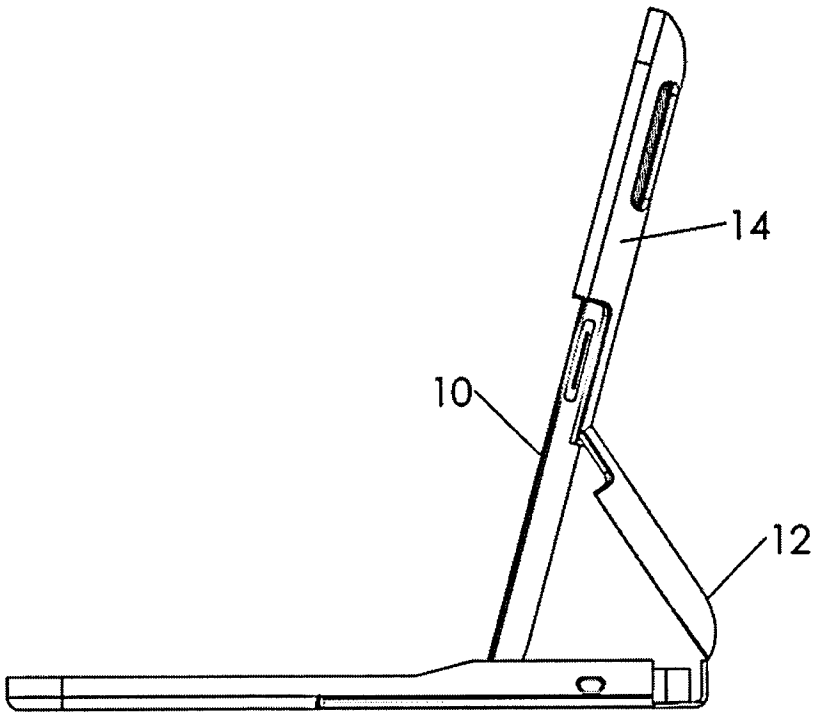
FIG. 8D is a right side view of the embodiment illustrated in FIG. 8A.
Figures 9, 10:
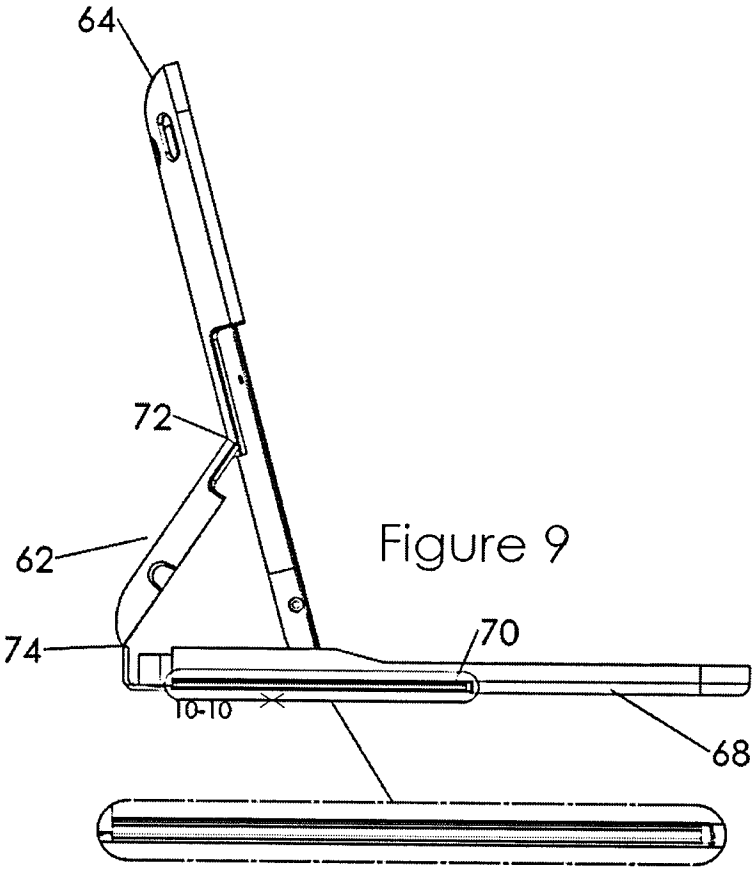
FIG. 9 is a left side view of the embodiment illustrated in FIG. 8A.
FIG. 10 is a partial view illustrating one embodiment of a rail mount.

Referring now to FIGS. 6A-6G, depicted is the case 15 with the IPAD 10 attached to the case by use of the rail type attachment mechanism 46-50 and release latch 49. FIG. 6B is an enlargement of the rail type mounting elements 46-50 which engage the bottom section 16 for maintaining the IPAD in position. As illustrated, a portion of the rail type attachment snaps or slides over a portion of the IPAD case 15 to provide two points of contact and location. The third contact and location point is provided by the release latch 48, which also catches on a portion of the case 15 to provide a secure attachment between the two.

FIGS. 7A-E, 8A-D, 9, and 10 depict a second embodiment wherein IPAD 60 includes a rear section 62, a front section 64 and a bottom section 68. In this embodiment, the lower section 68 includes a low-profile rail mount 70 that would be used to engage the case. As with the previous embodiment, the front section 64, rear section 62 and bottom section 68 are coupled together by a flexible outer skin forming a living hinge 72, 74.

Figure 11:
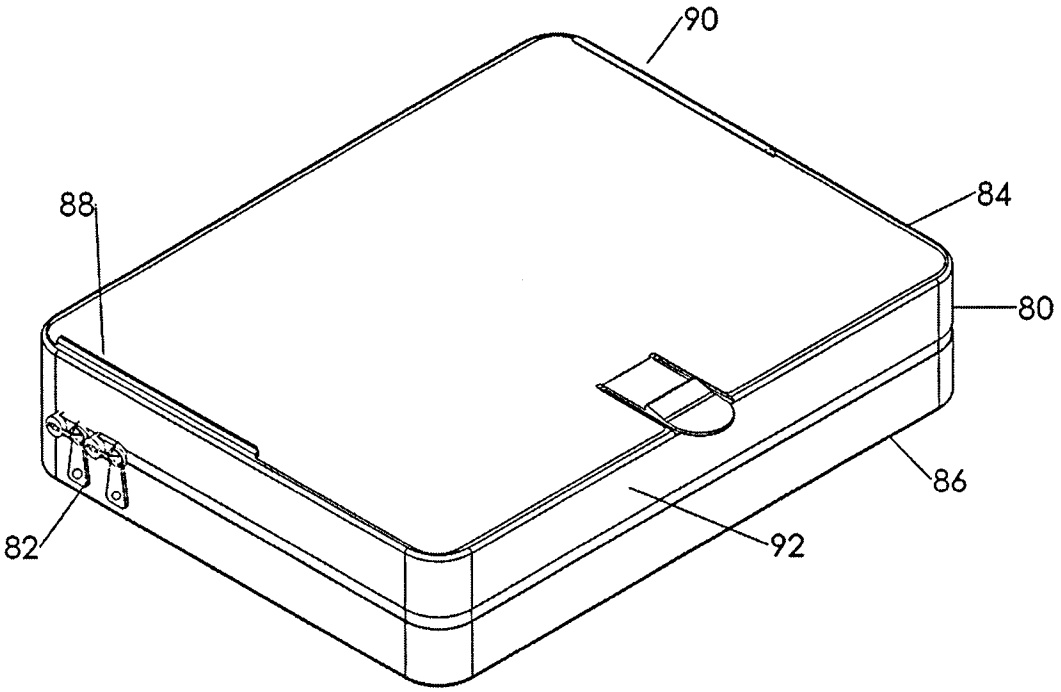
FIG. 11 is a perspective view of a case used in the second embodiment construction.

Now referring to FIG. 11, illustrated is a case 80, having tumbler zipper locks 82. As in the previous embodiment, the case is a housing having a first closable panel 84 connected to a second closable panel 86, defining the interior and exterior of the housing. The exterior of the first panel 84 has a low-profile rail mount 88 and 90 or "IAS" which runs along the length of the case. A release latch 92 is used for coupling to the bottom section 68 for securing the IPAD 10 in position. In this embodiment, the case may be formed to include hard outer panels which may be formed of plastic, metal, carbon fiber or a suitable combination thereof.

Figure 12A:
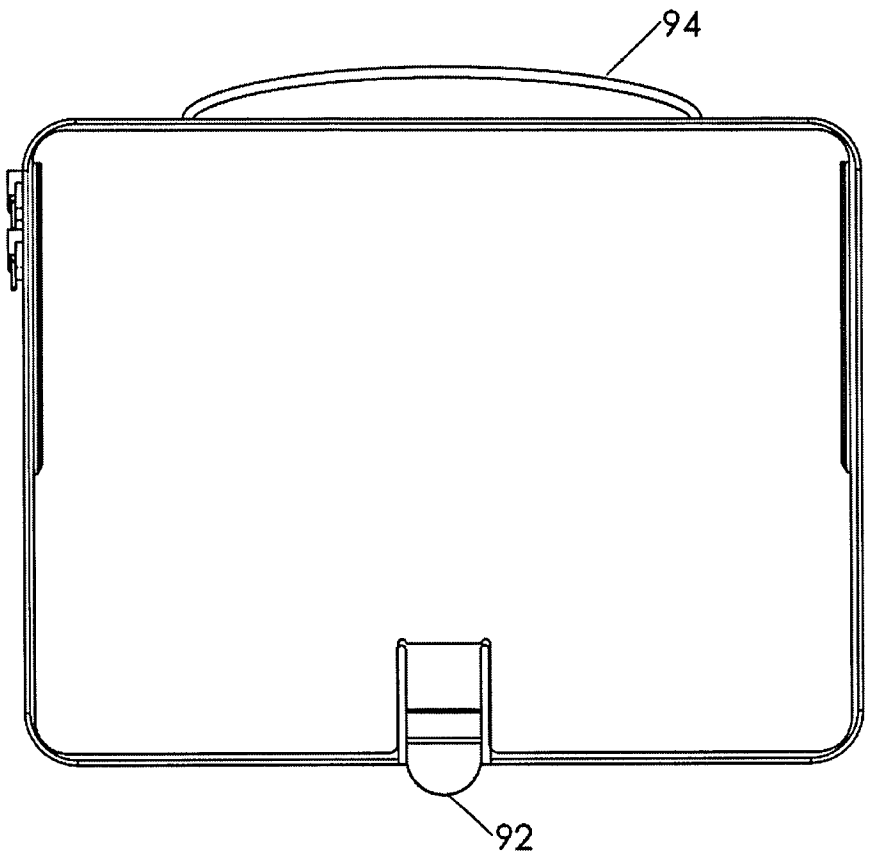
FIG. 12A is a top view of FIG. 11.

Referring to FIG. 12A, the case may include a nylon carrying strap 94 to allow ease of transportation, carrying strap 94 including connection to the IPAD, not shown in this Figure.

Figures 12B, 12C:
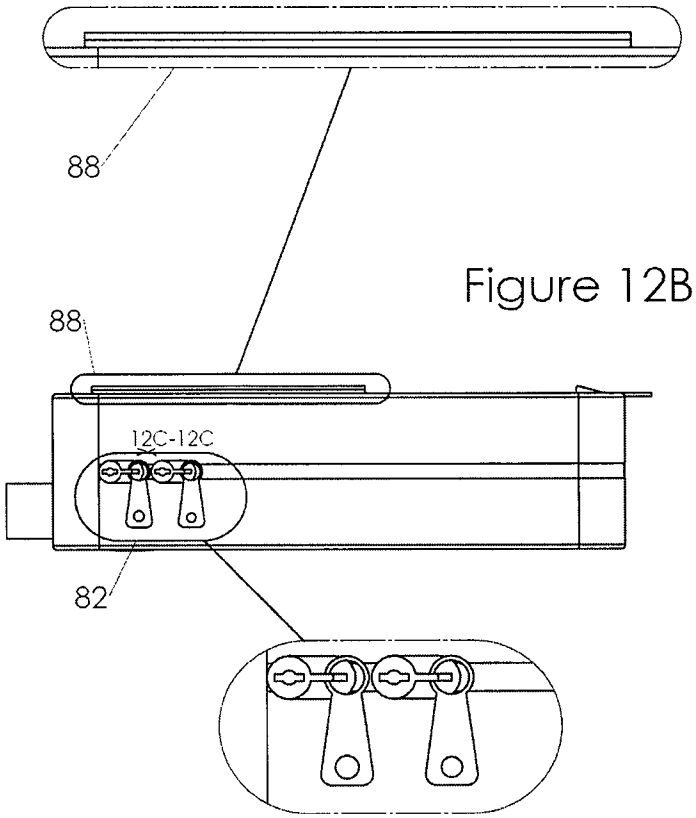
FIG. 12B is a left side view of FIG. 11.
FIG. 12C is an enlarged view taken along lines 12C-12C of the zippers of FIG. 12B.
Figures 12D, 12F:
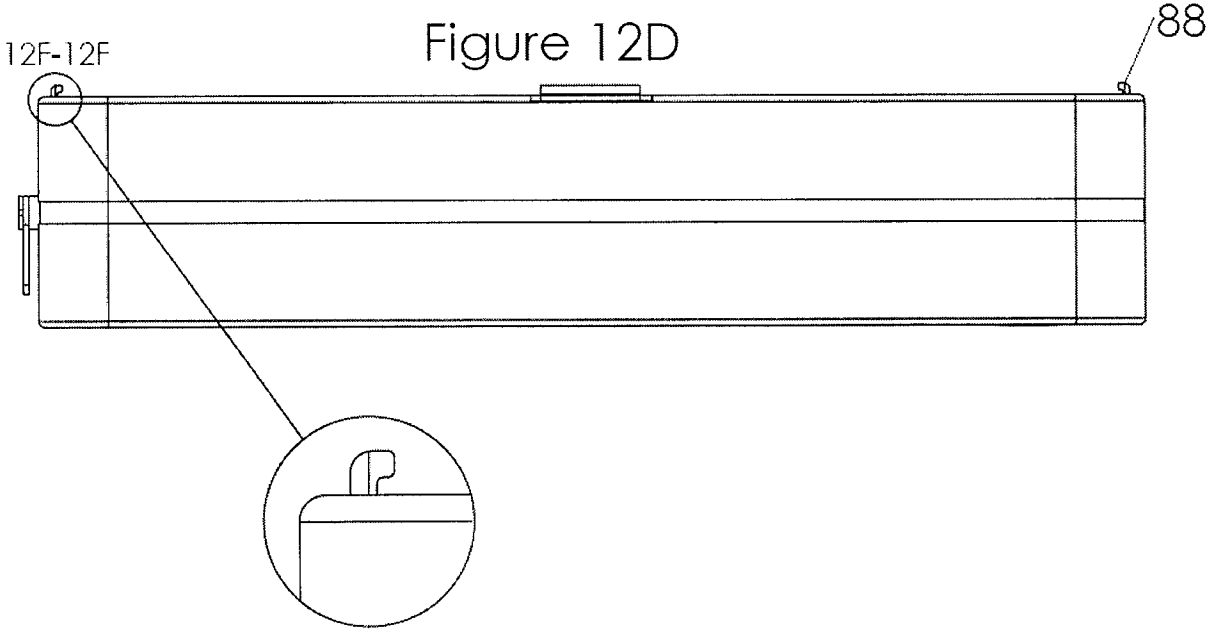
FIG. 12D is a front view of the embodiment illustrated in FIG. 11.
FIG. 12F is a partial view taken along lines 12F-12F of FIG. 12D.
Figure 12E:
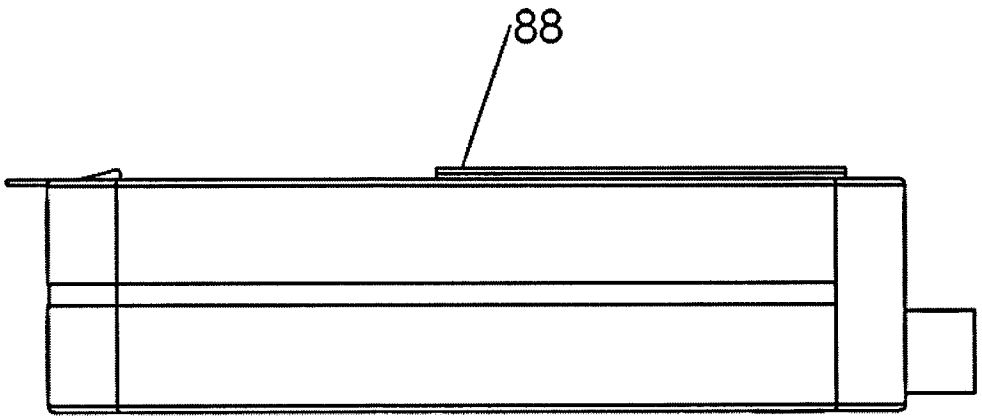
FIG. 12E is a right side view of the embodiment illustrated in FIG. 11.

FIG. 12B illustrates the tumbler zipper locks 82 which, in this embodiment, have an integrated tumble key lock depicted in FIG. 12C. The low-profile rail mount 88 is illustrated in FIG. 12C and runs a partial length of the case.

Figures 13A, 13B:
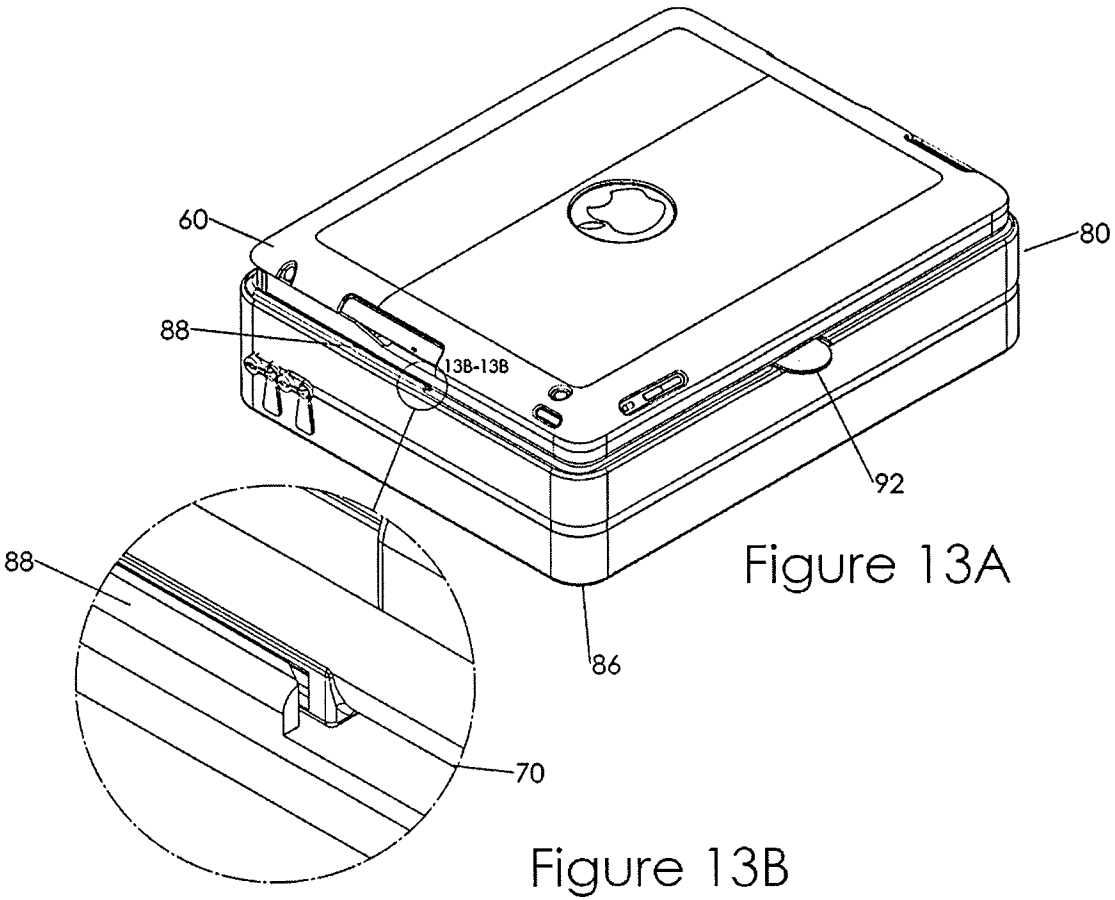
FIG. 13A is a perspective view of the IPAD and case of the second embodiment.
FIG. 13B is an enlarged view taken along lines 13B-13B of FIG. 13A, illustrating the rail attachment.
Figure 13C:
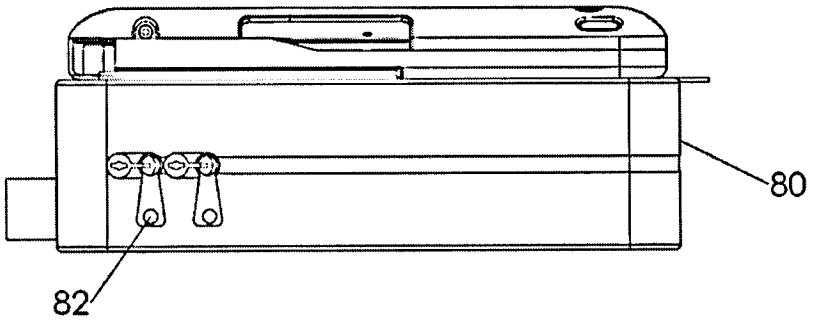
FIG. 13C is a left side view of the embodiment illustrated in FIG. 13A.
Figure 13D:
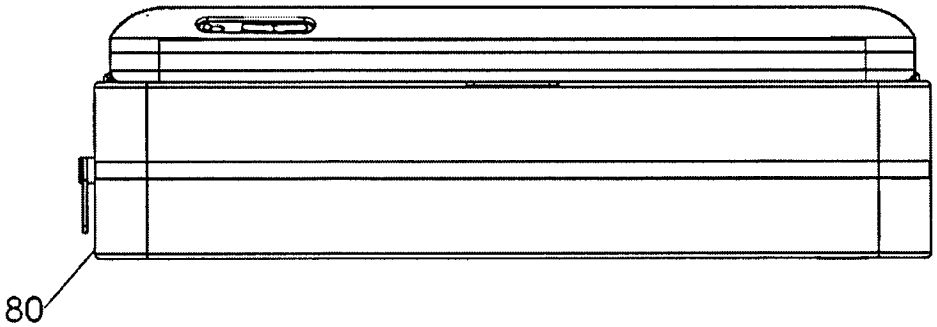
FIG. 13D is a front view of the embodiment illustrated in FIG. 13A.

Referring to FIG. 13A, the case 80 is shown with the IPAD 60 mounted thereon by use of the low-profile rail mount 88 and release latch 92. FIG. 13B is an enlargement of the low profile rail mount 88.

Figure 14A:
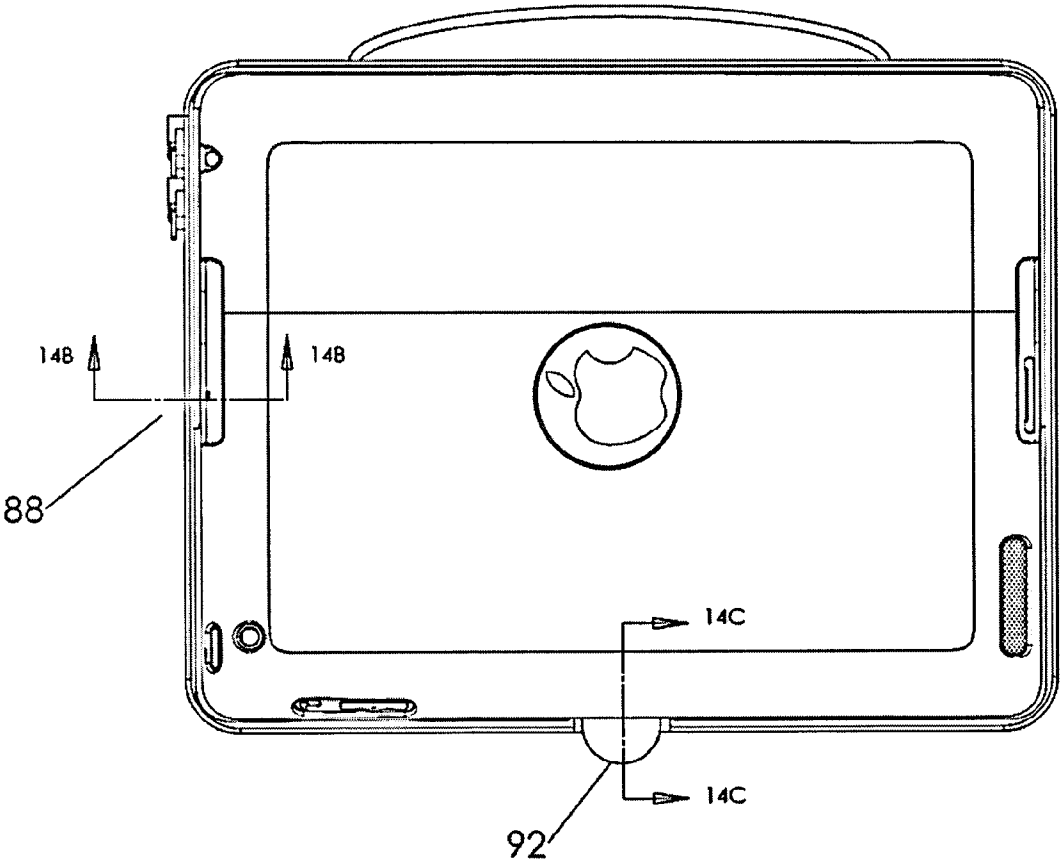
FIG. 14A is a top view of FIG. 13A.
Figure 14C:
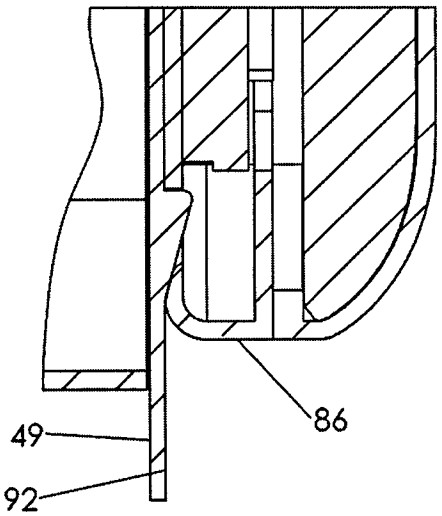
FIG. 14C is an enlarged cross sectional view taken along lines 14C-14C of FIG. 14A.
Figure 14B:
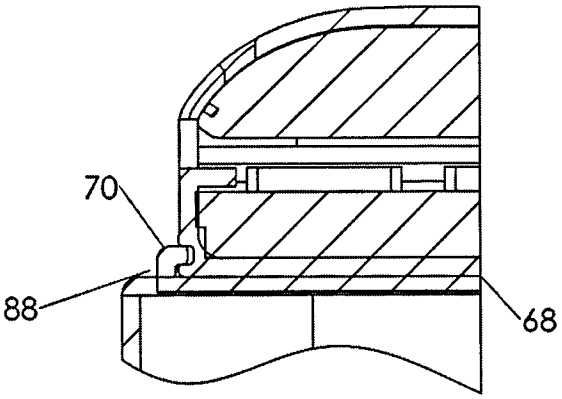
FIG. 14B is an enlarged cross sectional view taken along lines 14B-14B of FIG. 14A.

FIG. 14A further illustrates the release latch 92, showing coupling to the bottom section 86 in FIG. 14C. The low-profile rail mount 88 is depicted in FIG. 14B coupling to bottom section 86.

Figure 15:
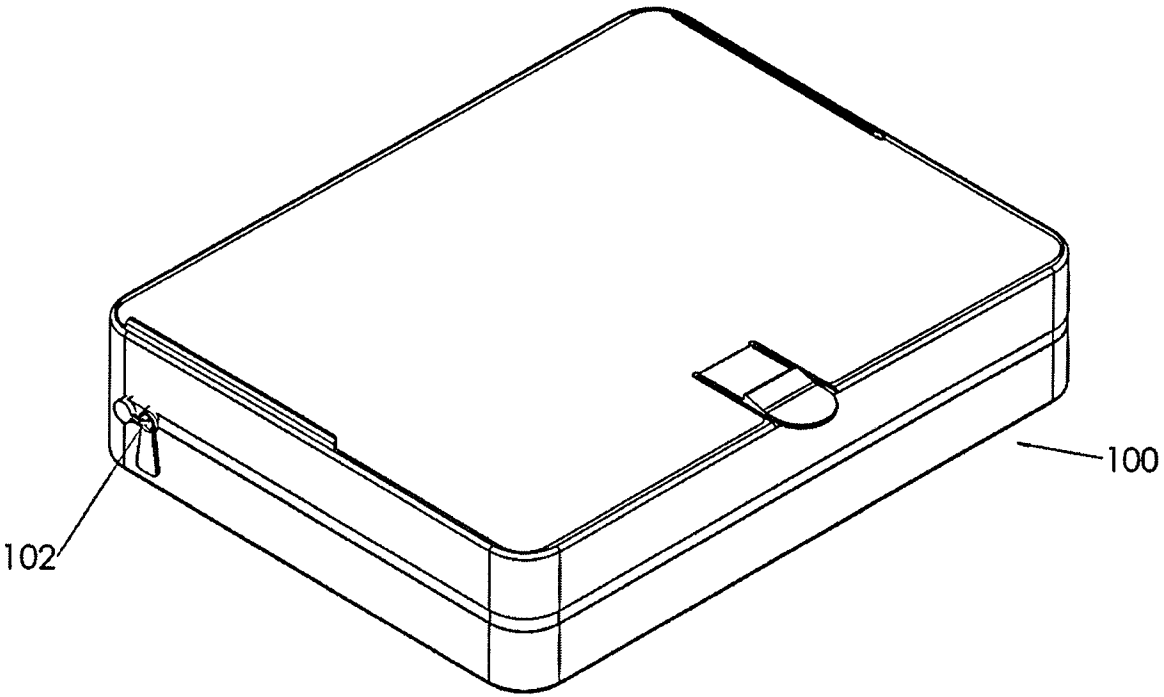
FIG. 15 is a perspective view of a biometric zipper embodiment on a case.
Figure 16:
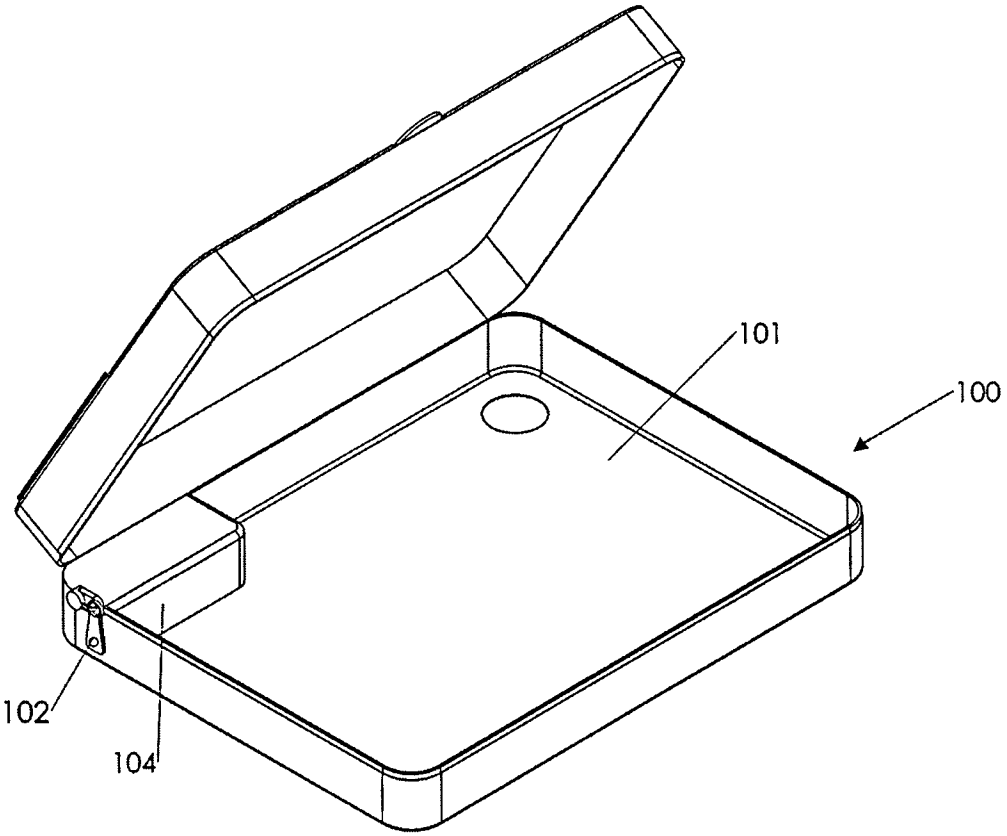
FIG. 16 is a perspective view of a biometric zipper embodiment of the case in FIG. 15 in an open position.
Figure 17A:
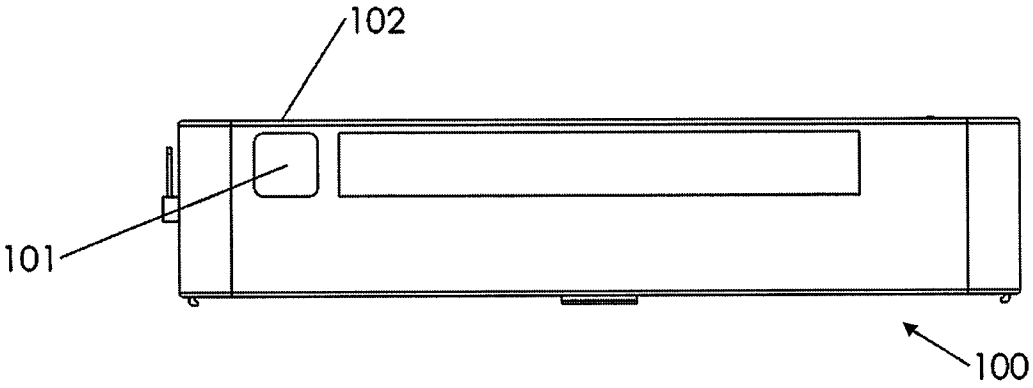
FIG. 17A is a rear view of FIG. 15.
Figure 17B:
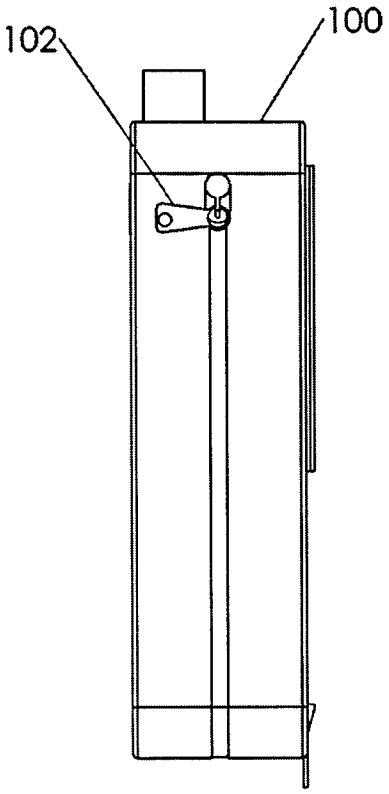
FIG. 17B is a left side view of FIG. 15.
Figure 17C:
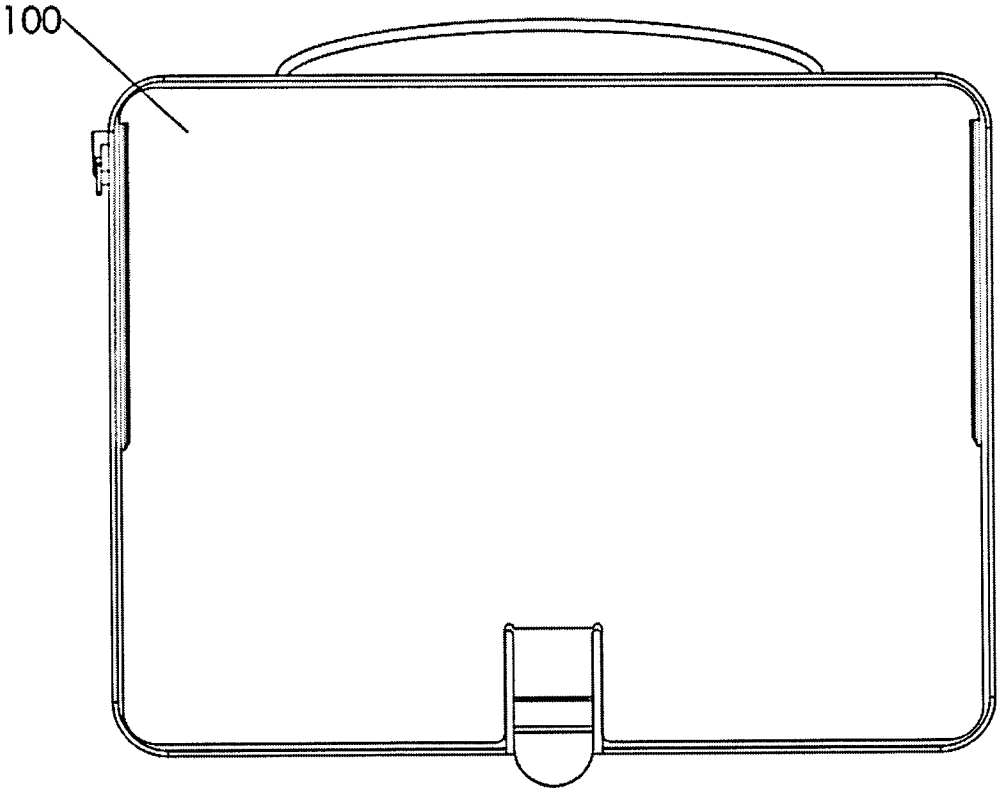
FIG. 17C is a top view of FIG. 15.

FIG. 15 depicts a storage case 100, which includes biometric zipper locks 102. The biometric zipper lock is battery powered and placed within the corner of the interior 101 in a battery powered biometric zipper lock 102. FIG. 17A illustrates one embodiment of the biometric sensor 101 to biometric zipper locks 102 located along a side of the case 100, which requires the individual to display the correct fingerprint in order to unlock the case and access firearm placed therein.

Figure 19:
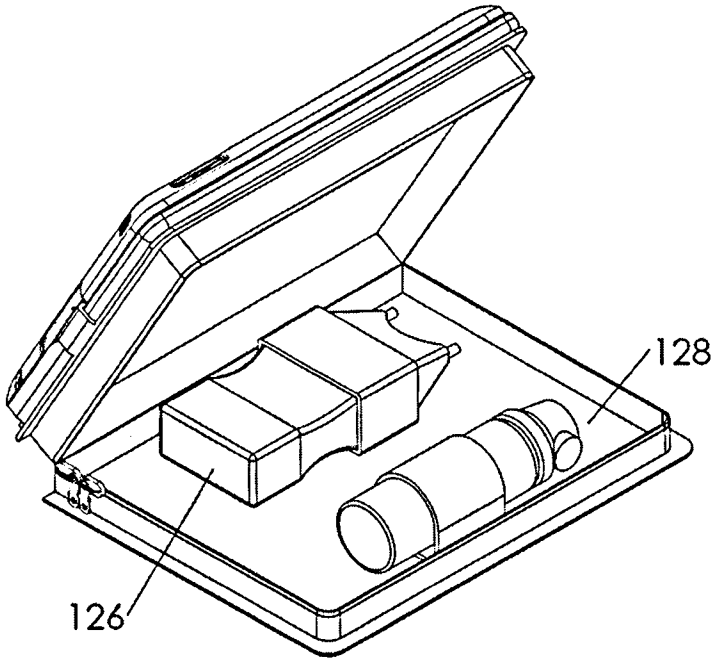
FIG. 19 is a pictorial view of the case with a stun gun and pepper spray.
Figure 18:
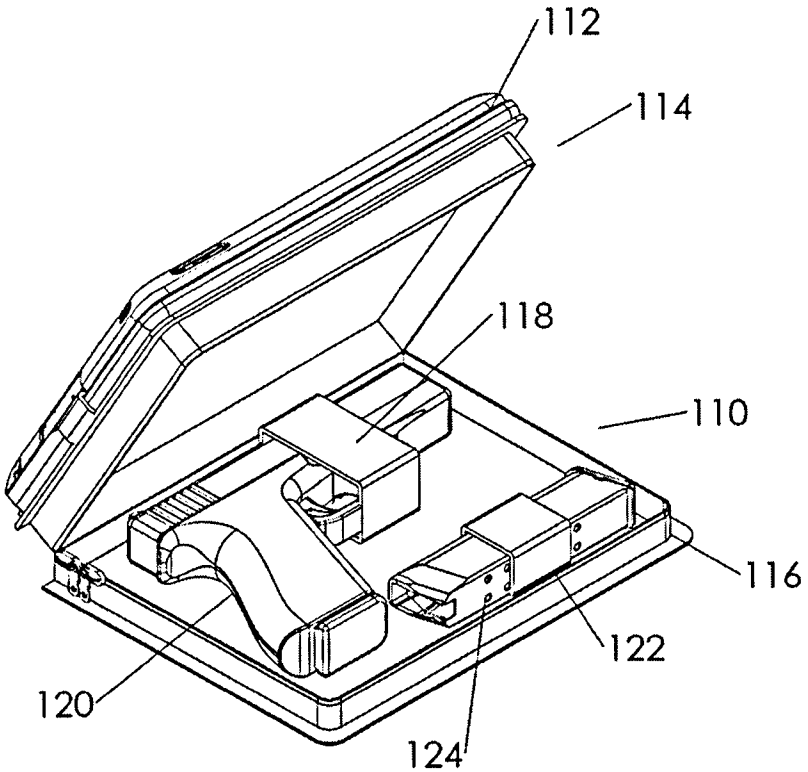
FIG. 18 is a pictorial view of one embodiment of the case with a firearm.

Referring now to FIGS. 18-19, shown is case 110 having an IPAD 112 mounted on top of the first panel 114. The interior of the second panel 116 includes a first holder 118 for securement of a firearm 120. A second holder 122 is used for holding ammunition, such as an ammo clip 124. As illustrated in FIG. 19, the firearm may be a stun gun 126 and a can of mace 128, all of which are again concealed within the compartment and placed beneath the IPAD.

Figure 20B:
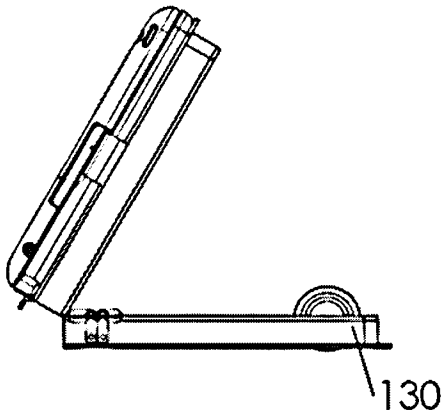
FIG. 20B is a left side view of FIG. 20A.
Figure 20A:
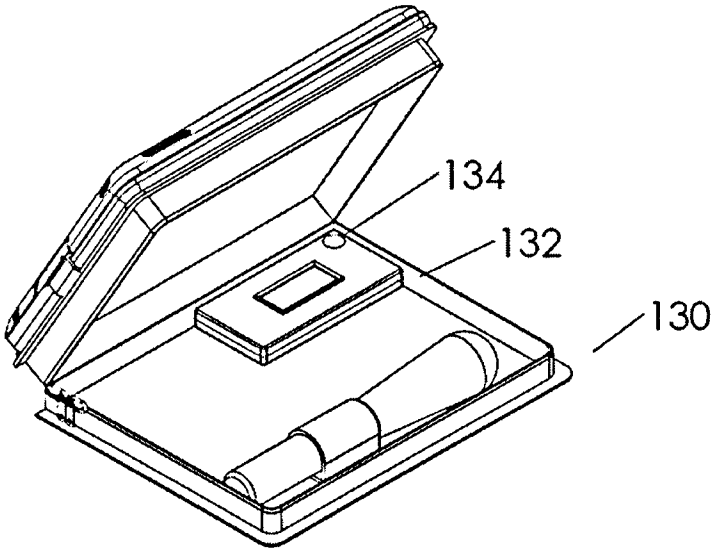
FIG. 20A is a pictorial view of the case with a GPS locator.
Figure 21:
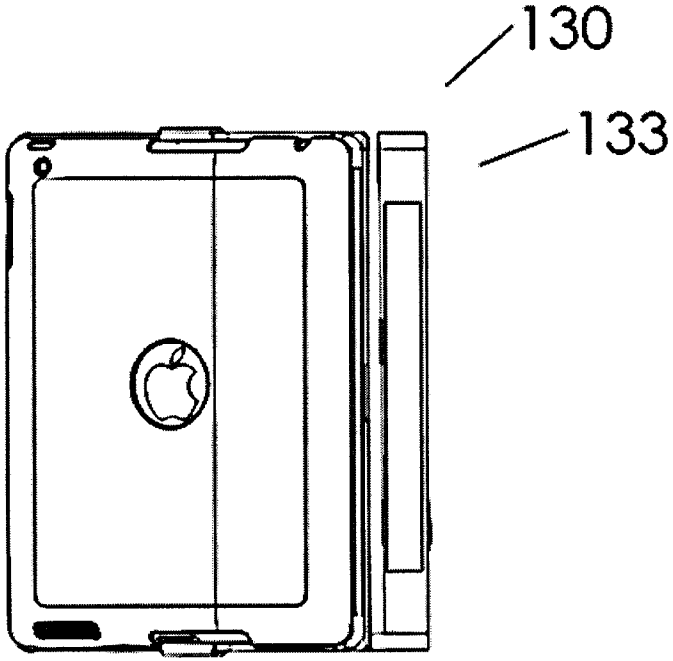
FIG. 21 is a rear view of FIG. 20A.

FIGS. 20A and 20B set forth yet another embodiment with a case 130 having a GPS locator 132 with an internal panic button 134, wherein a firearm is replaced with a detection device for those who do not agree with self-defense, but would rather look for outside help. As shown in FIG. 21, the case 130 may include a baton 133 or safety light for self-defense.

Figure 22:
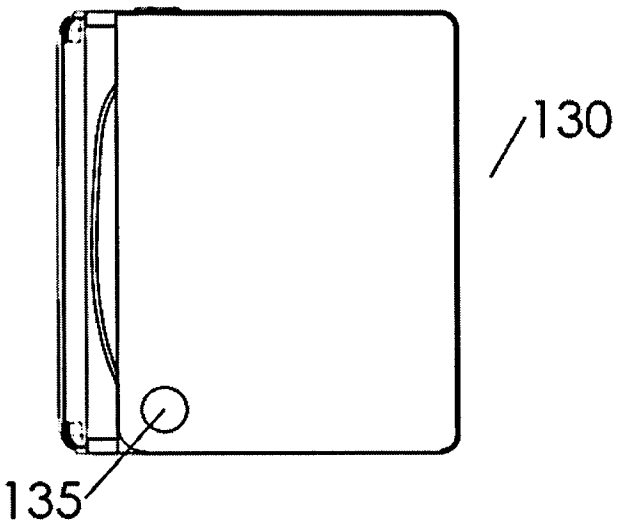
FIG. 22 is a bottom view of FIG. 20A.

Shown in FIG. 22 is a case 130 with an external panic button 135 for operating the GPS locator device 132 described in FIGS. 20A and 20B.

Figure 23:
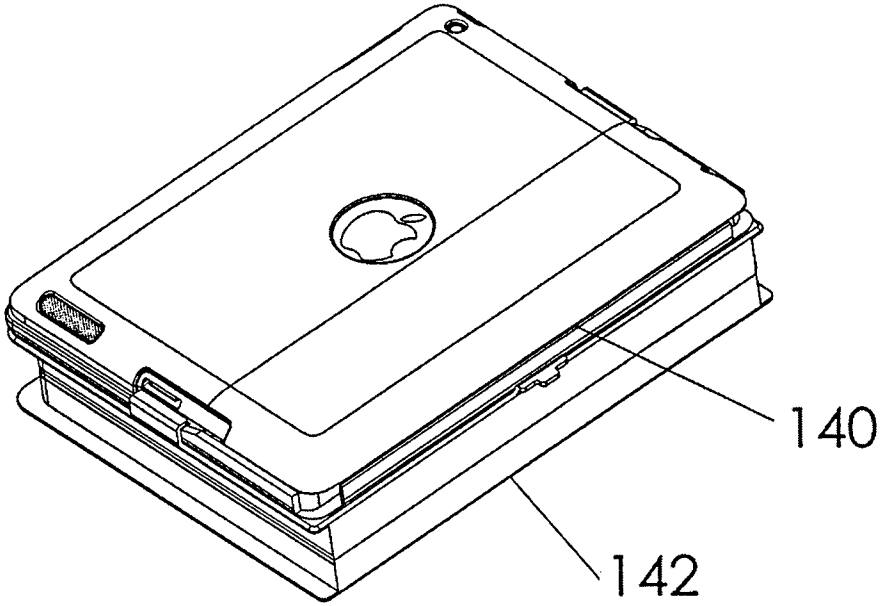
FIG. 23 is a perspective view of a third embodiment.

FIG. 23 depicts a conventional IPAD case 140 placed on top of a firearm case 142.

Figure 24:
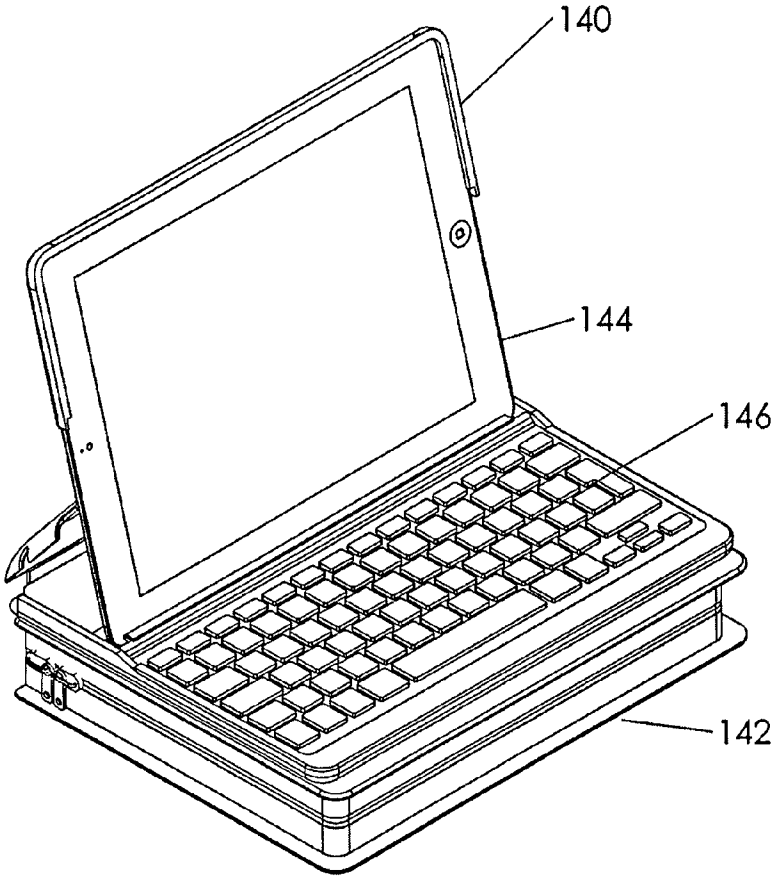
FIG. 24 is a perspective view of FIG. 23 in an open position.

FIG. 24 illustrates the IPAD in an open position with the screen display 144 and a wireless keyboard 146 positioned on top of the firearm case 142.

Figure 25:
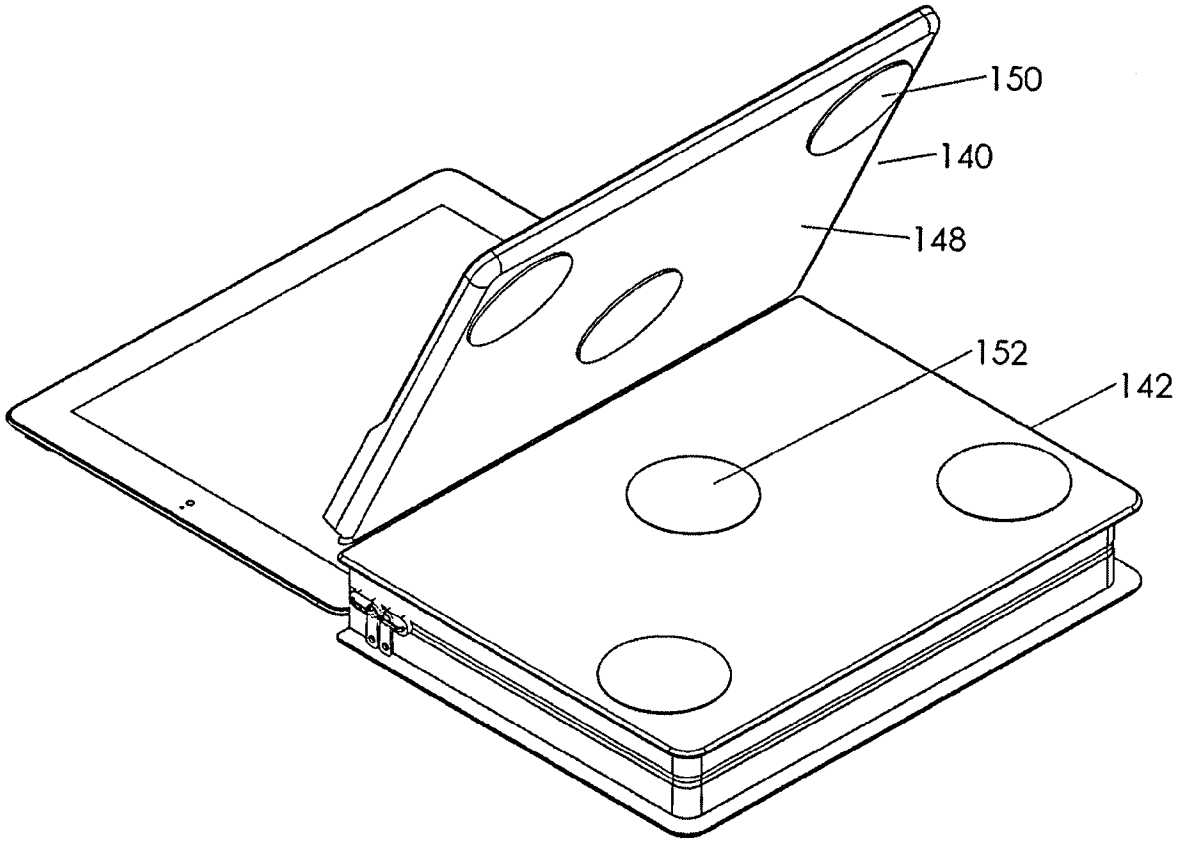
FIG. 25 is a perspective view of the IPAD illustrated in FIG. 23 separated from the case.

FIG. 25 depicts the conventional IPAD case 140 having a bottom surface 148 and a series of hook and loop attachments 150 securable to the firearm case 142, having reciprocal hook and loop attachments 152.

Figure 26:
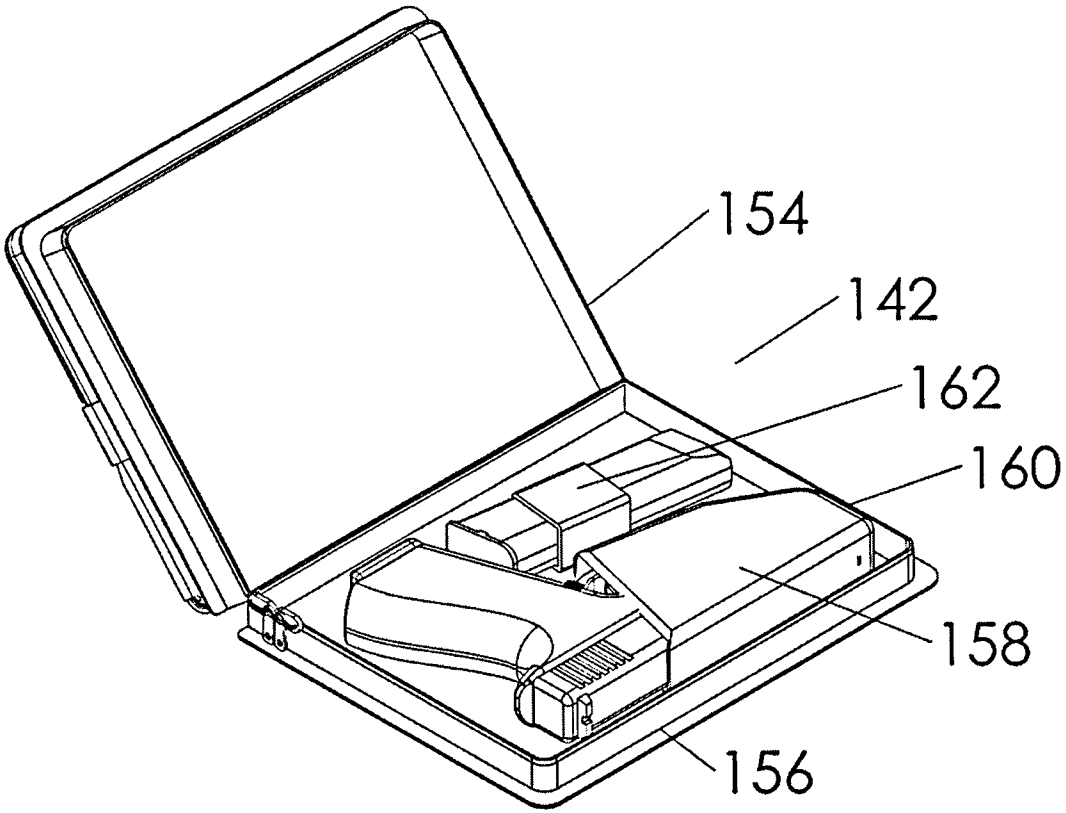
FIG. 26 is a perspective view of a firearm placed within a case formed from the third embodiment.

FIG. 26 illustrates the firearm case 142 having an interior 154, with firearm 156 placed within a holster 158 and clip 160 secured by a hook and loop strap 162.

Figure 41:
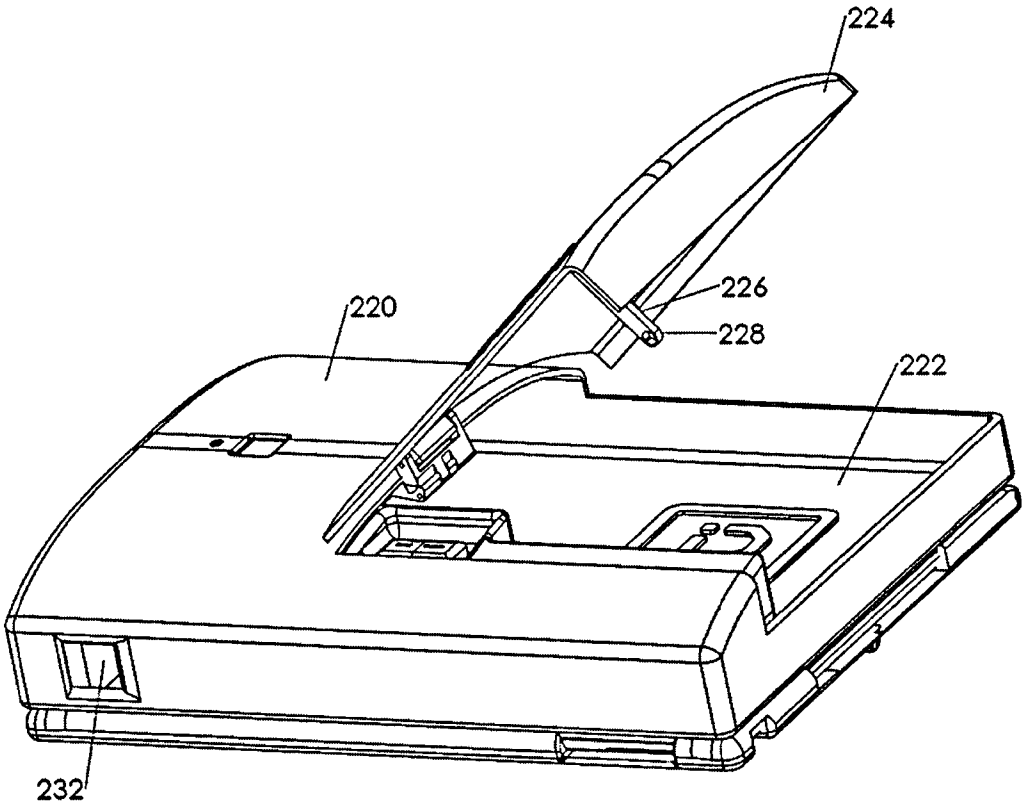
FIG. 41 is a rear perspective view illustrating the firearm access door in an open position.
Figure 42:
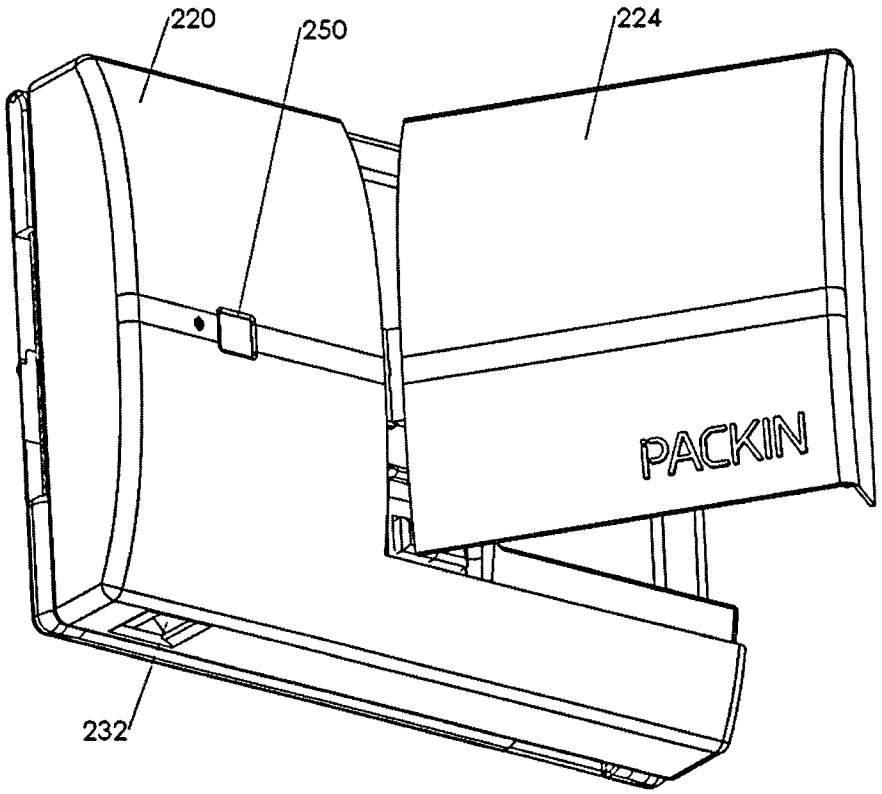
FIG. 42 is a rear perspective view illustrating the firearm access door in an open position.
Figure 43:
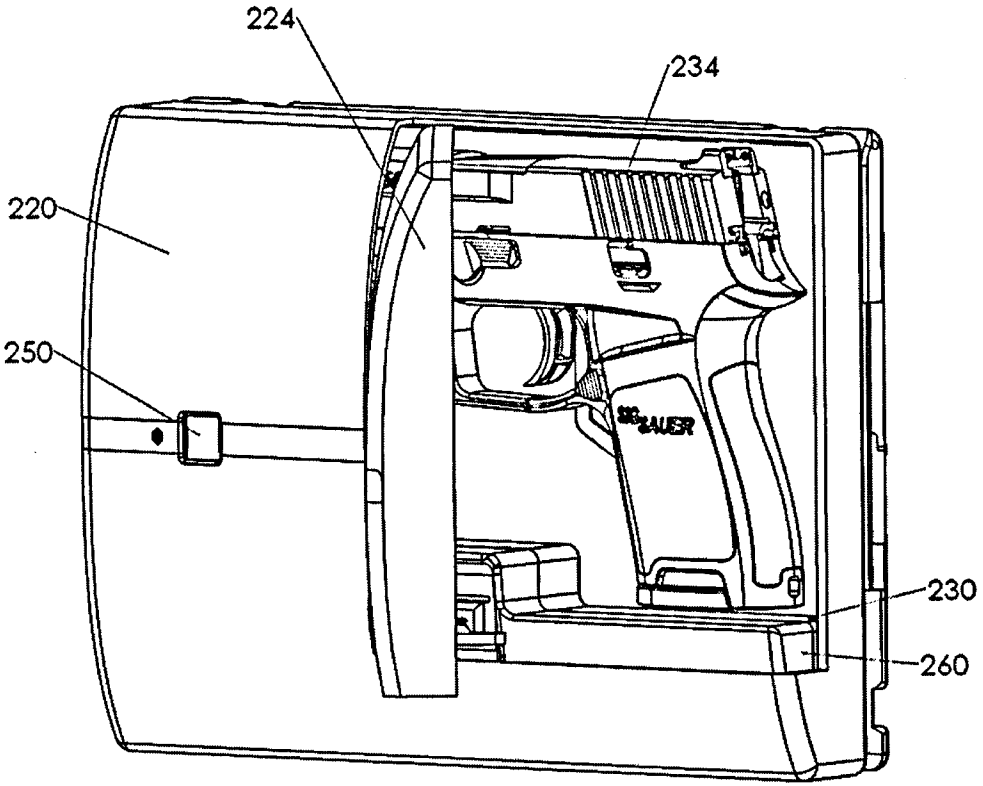
FIG. 43 is a rear perspective view illustrating the firearm access door in an open position and a firearm in position.
Figure 44:
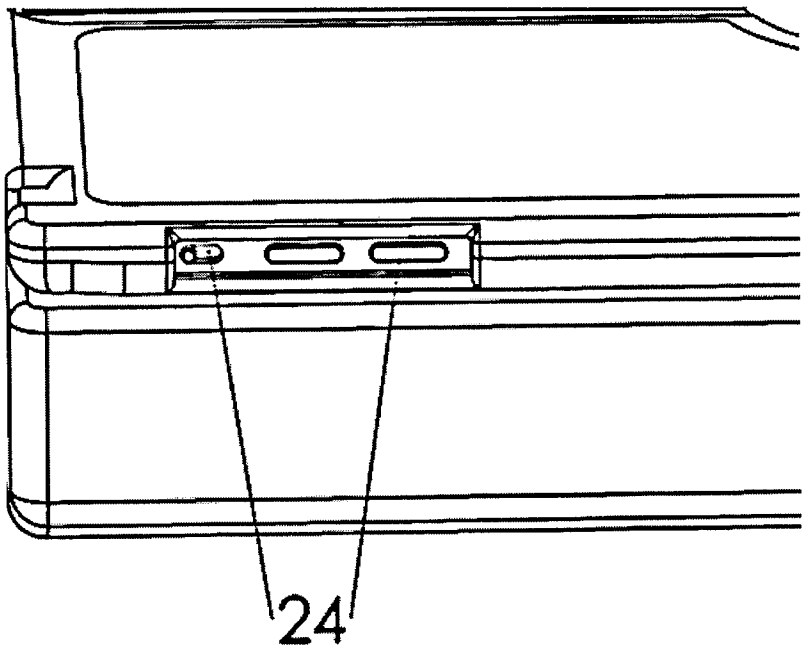
FIG. 44 is a partial rear side view illustrating a portion of the ports for connection to the electronic tablet device through the covers of the present device.
Figure 45:
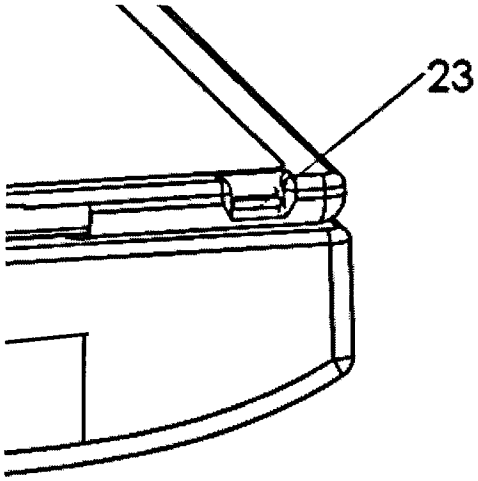
FIG. 45 is a partial rear side view illustrating a portion of the ports for connection to the electronic tablet device through the covers of the present device.

Now referring generally to FIGS. 27-48, an alternative embodiment of the firearm concealing electronic tablet case 200 is illustrated. The electronic tablet case 200 includes a first shell panel 212 hingedly connected to a second shell panel 214. The second shell panel 214 is hingedly connected to a rear shell panel 216. The rear shell panel 216 includes a plurality of sidewalls 218 extending substantially perpendicular with respect to the rear shell panel 216 and away from said first and said second shell panels. A rear cover panel 220 (FIG. 28) connects said sidewalls 218 to define a hollow interior portion 222 (FIG. 41). The rear cover panel 220 is preferably curved along the longitudinal axis of the case for ergonomics. An access door 224 forms a portion of the rear cover panel 220. The access door 224 is hingedly connected to the rear cover panel 220 for movement between an open and a closed position. A lock assembly 226 having a catch 228 and a latch member 230 (FIG. 43) is for controllably preventing the release of the access door to unauthorized user's. In the preferred embodiment, the lock assembly is an electronic lock having at least one battery and the electronics for operation of the electronic lock positioned within the hollow interior portion 222 of the electronic tablet case. In at least one embodiment, the electronic lock assembly 226 is biometrically operated. In this embodiment, a biometric identifier 232 is provided wherein a user may slide his/her finger onto the biometric identifier 232 for identification through fingerprint or the like. If the user is properly identified, the electronic lock assembly 226 will allow the access door 224 to be opened for access to the hollow interior portion 222 of the electronic tablet case. The hollow interior portion 222 includes a support member for securing a weapon therein. In a most preferred embodiment, the weapon is a handgun 234 (FIG. 43). Alternatively, a stun gun, pepper spray or the like may be stored within the hollow interior portion 222 without departing from the scope of the invention. Holsters or the like (not shown) may also be inserted or secured within the hollow interior portion to prevent the weapon from unintended movement.

Figure 27:
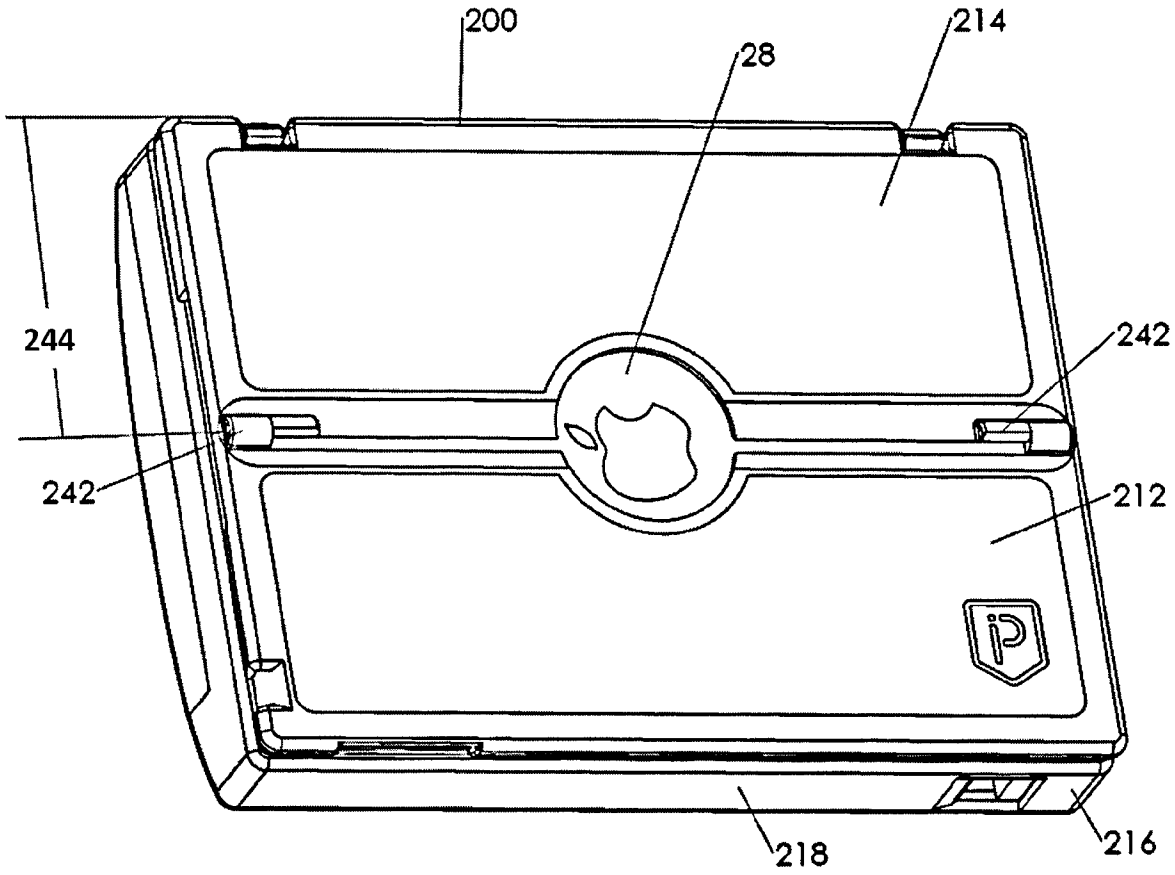
FIG. 27 is a front left perspective view of one embodiment of the present invention.
Figure 28:
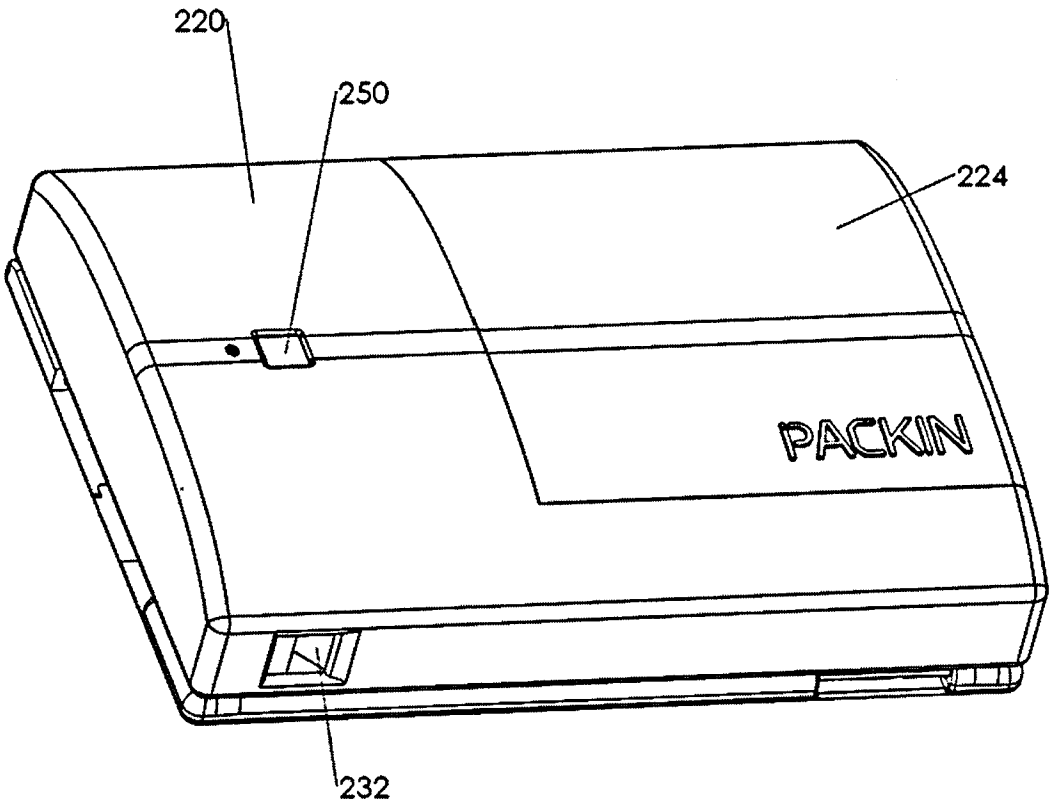
FIG. 28 is a rear right perspective view of the embodiment illustrated in FIG. 27.
Figure 29:
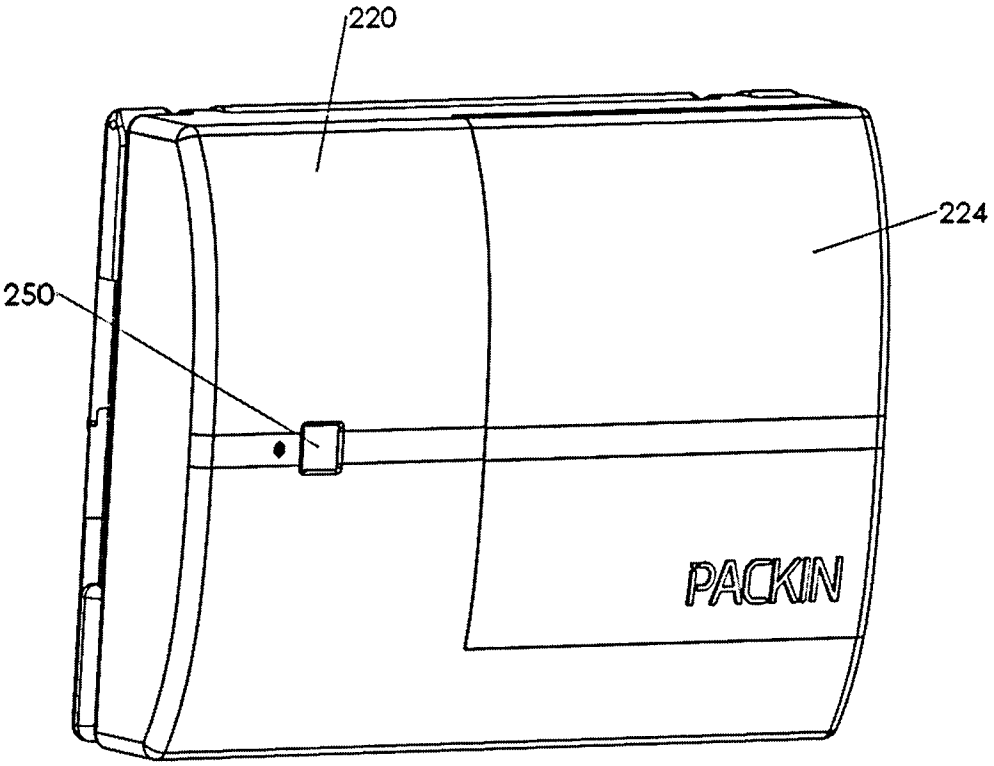
FIG. 29 is a rear right perspective view of the embodiment illustrated in FIG. 27.
Figure 30:
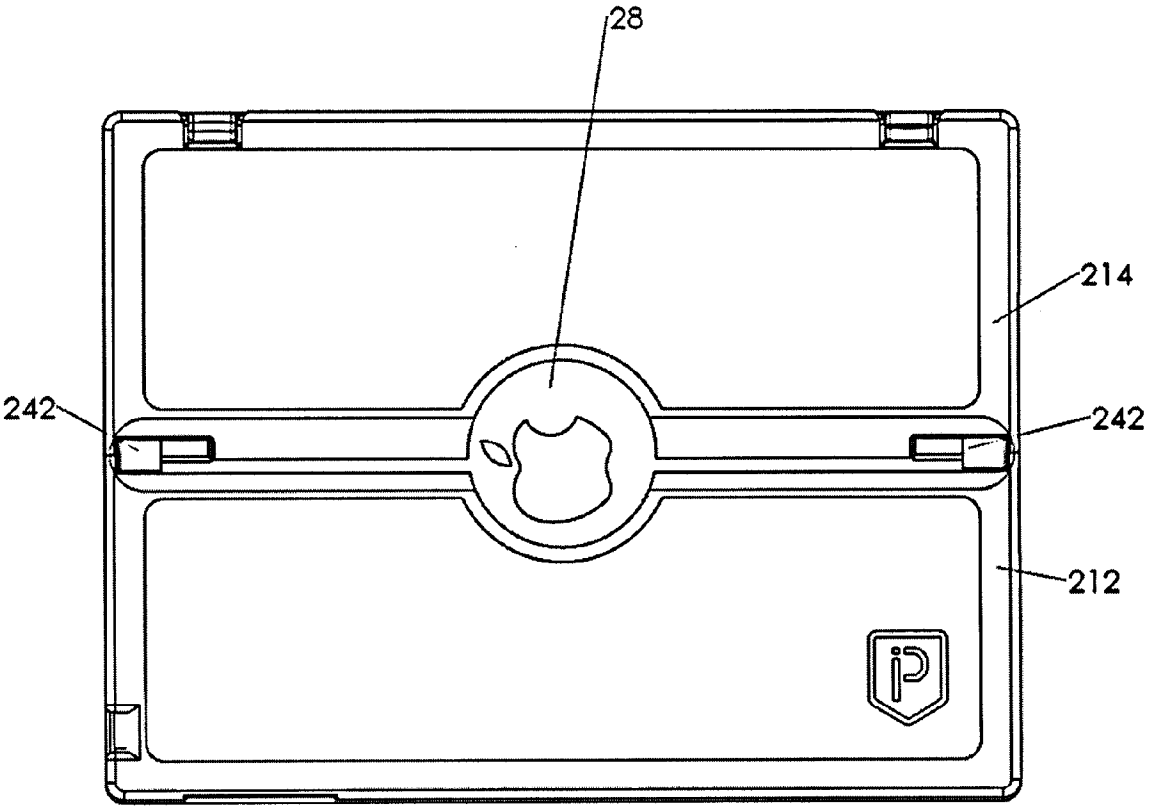
FIG. 30 is a front view of the embodiment illustrated in FIG. 27.
Figure 31:
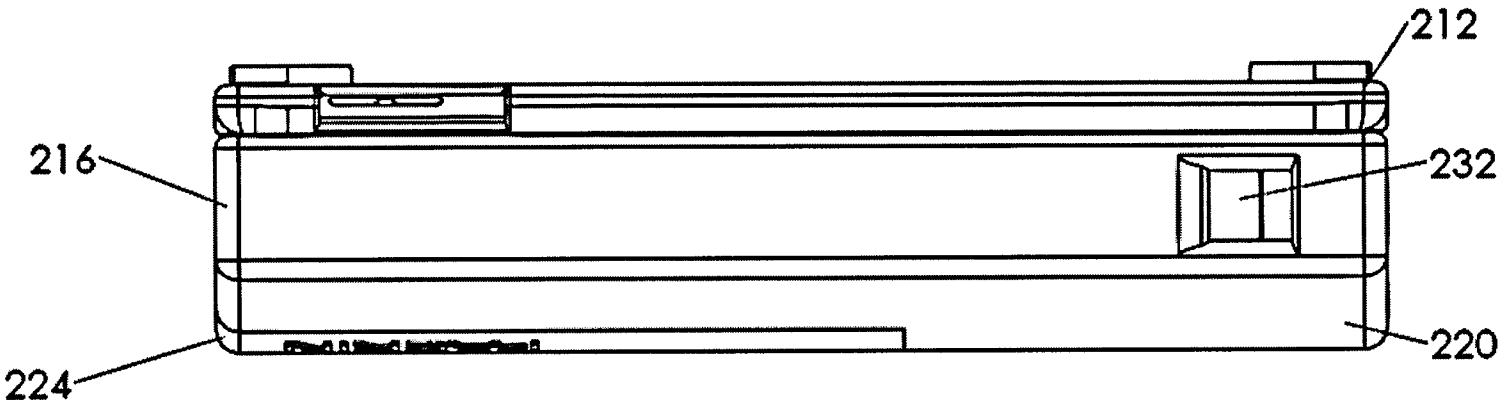
FIG. 31 is a bottom side view thereof.
Figure 32:
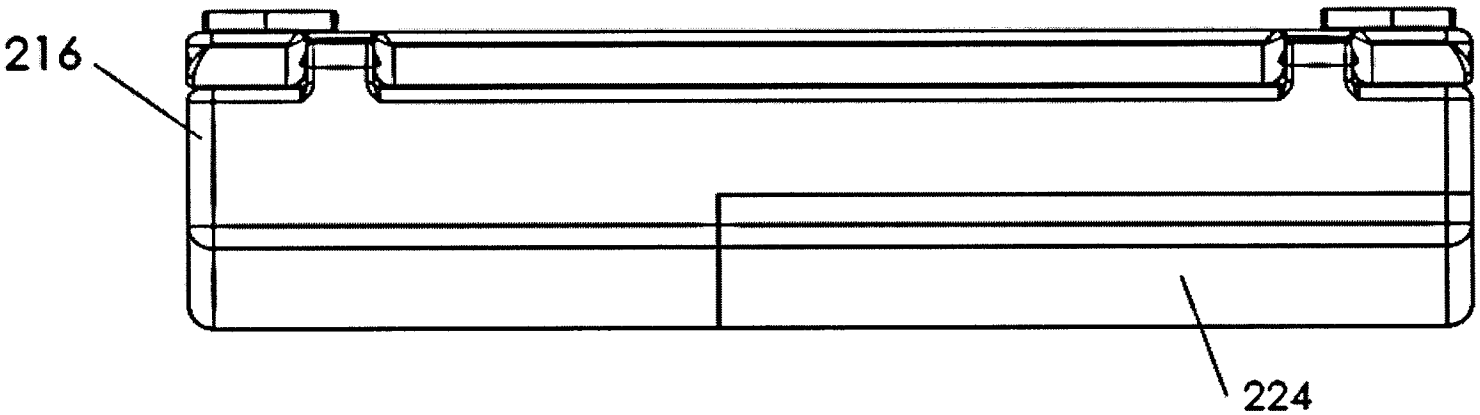
FIG. 32 is a top view thereof.
Figure 33:
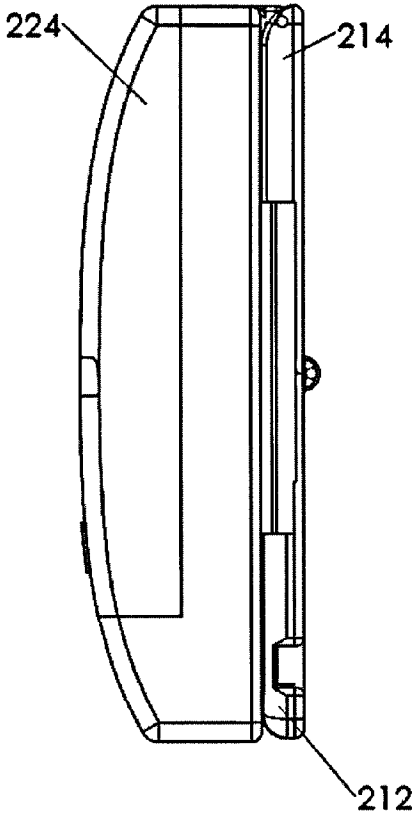
FIG. 33 is left side view thereof.
Figure 34:
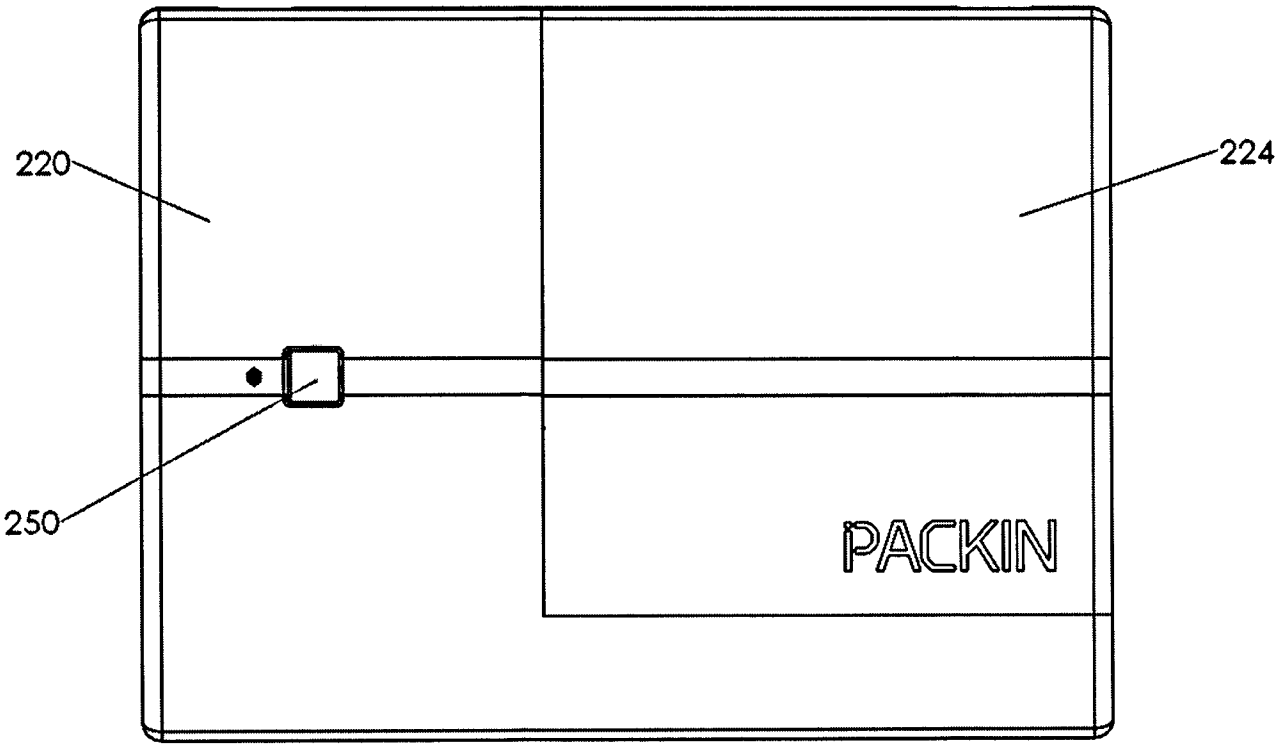
FIG. 34 is a rear view thereof.
Figure 35:
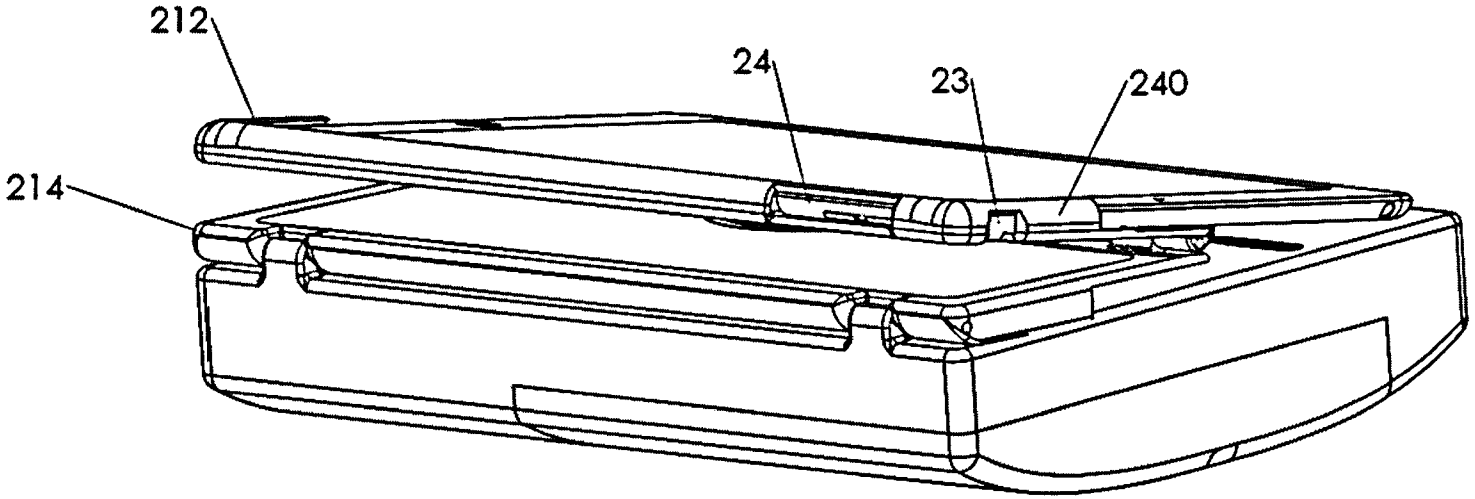
FIG. 35 is a front right perspective view illustrating the device in a partially open position.
Figure 36:
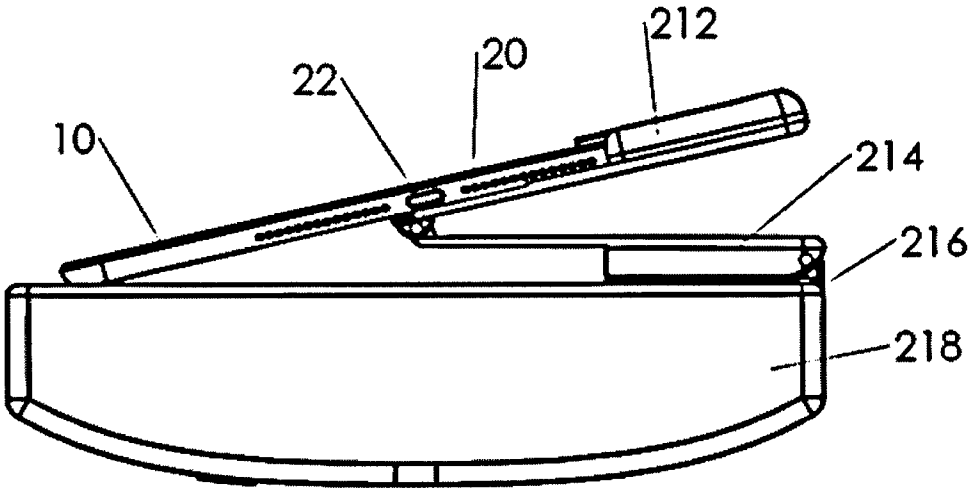
FIG. 36 is a right side view illustrating the device in a partially open position.
Figure 37:
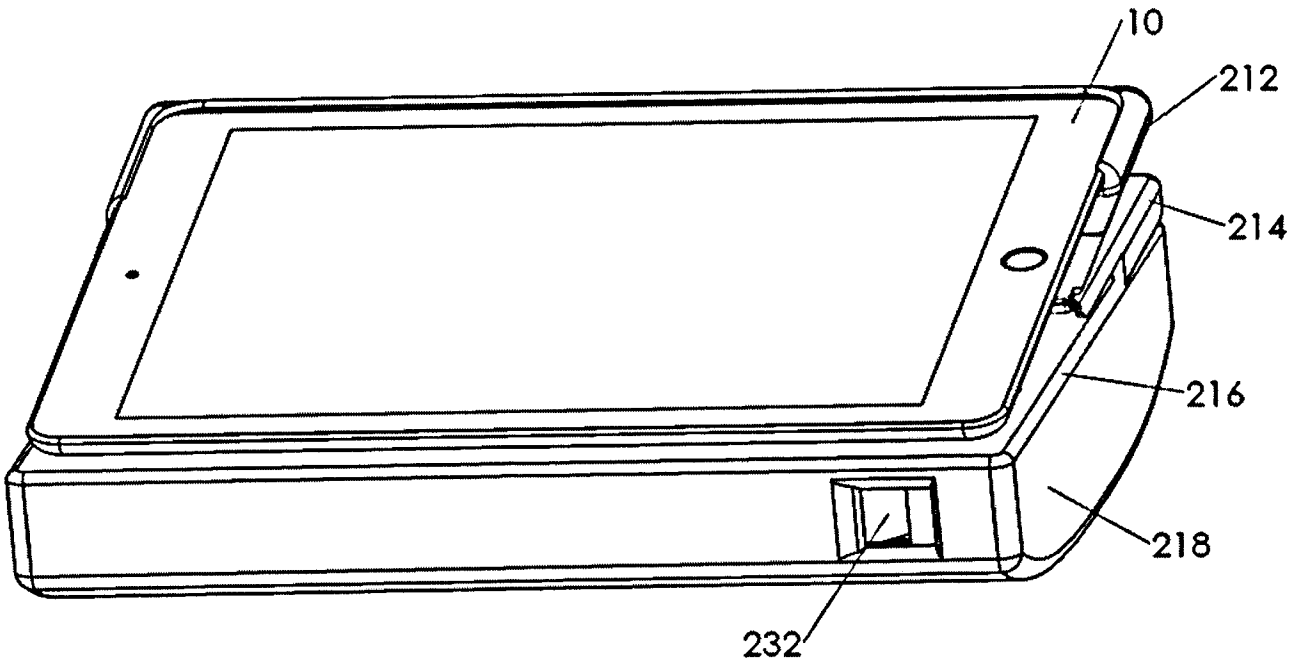
FIG. 37 is a perspective view illustrating the top cover in a position which allows access to the electronic device.
Figure 38:
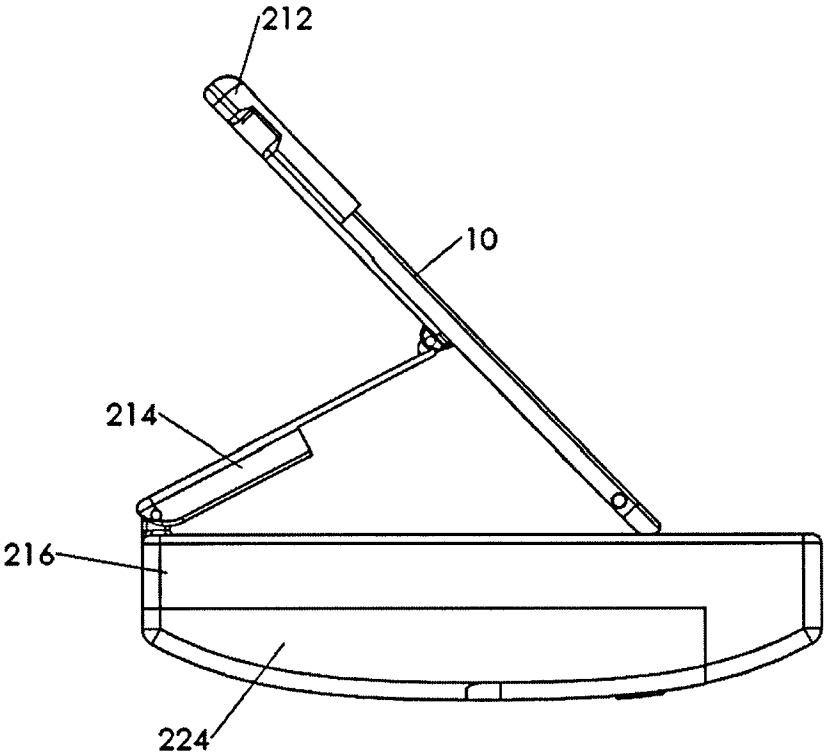
FIG. 38 is a side view illustrating the top cover in an alternate position.
Figure 39:
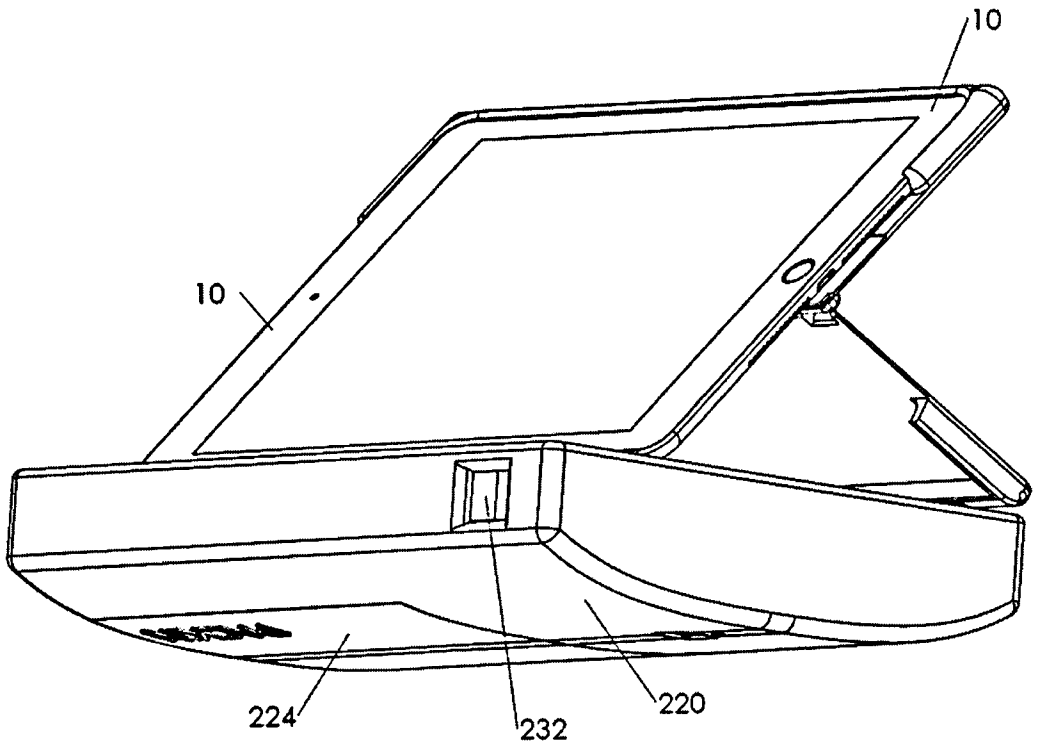
FIG. 39 is a perspective view of the top cover in an alternate position as shown in FIG. 38.
Figure 40:
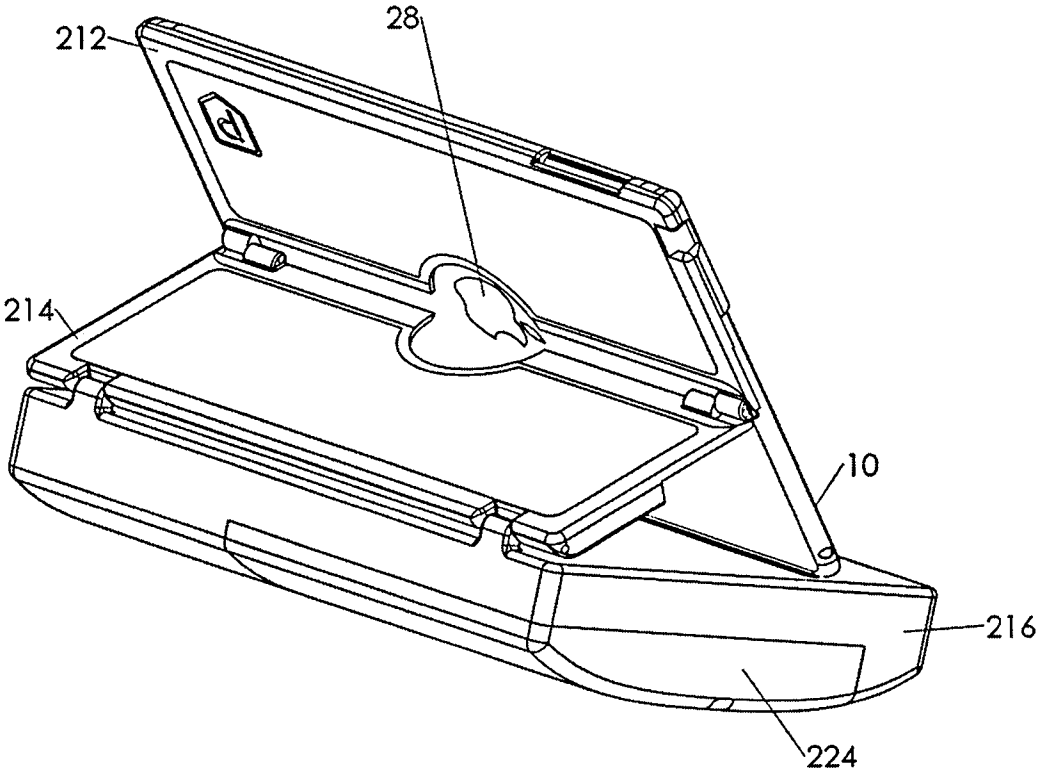
FIG. 40 is a rear perspective view of the top cover in an alternate position as shown in FIG. 38.

Referring to FIGS. 35-40, an inside portion of said first shell panel 212 includes mounting elements 240 for securing an electronic tablet thereto. In a preferred embodiment, the mounting elements comprise plastic members that can be flexed sufficiently to snap over a portion of the electronic tablet to hold the tablet and the panel together. The second shell panel 214 is hingedly connected to the first shell panel via hinges 242 (FIG. 30). Alternatively, living or other types of hinges or the like may be utilized in place of the pin type hinges illustrated in FIG. 27. The second shell panel 214 is contoured to cover a part of the rear portion of an electronic tablet while in a closed position, e.g. when the screen portion of said electronic tablet is facing a rear surface of said rear shell panel as illustrated in FIG. 27. The second shell panel 214 includes a width 244 (FIG. 27) which allows the second shell panel to be used as an angle brace (FIGS. 38-40) for supporting the electronic tablet in an angled position with respect to the rear shell panel 216. The first and second shell panels 212, 214 include access ports for speakers 20, charger 22, power button access 23, volume control 24, microphone, camera and the like which allows for full operation of the electronic tablet. Also present on versions for Apple products is an aperture window 28, provided so that the logo can be readily viewed from the outside of the case.

In at least one embodiment, the firearm concealing electronic tablet case includes a panic button 250 positioned at a rear portion of the case close to where the hands of a user carrying the case would be. The panic button may be connected to a cell phone and a global positioning device (GPS) whereby the coordinates of the alarm could be sent to authorities and a phone line could be opened to allow an operator or police to hear what is happening in the vicinity of the case. In some embodiments the panic button may be a biometric button to prevent others from inadvertently activating the panic button.

Figure 46:
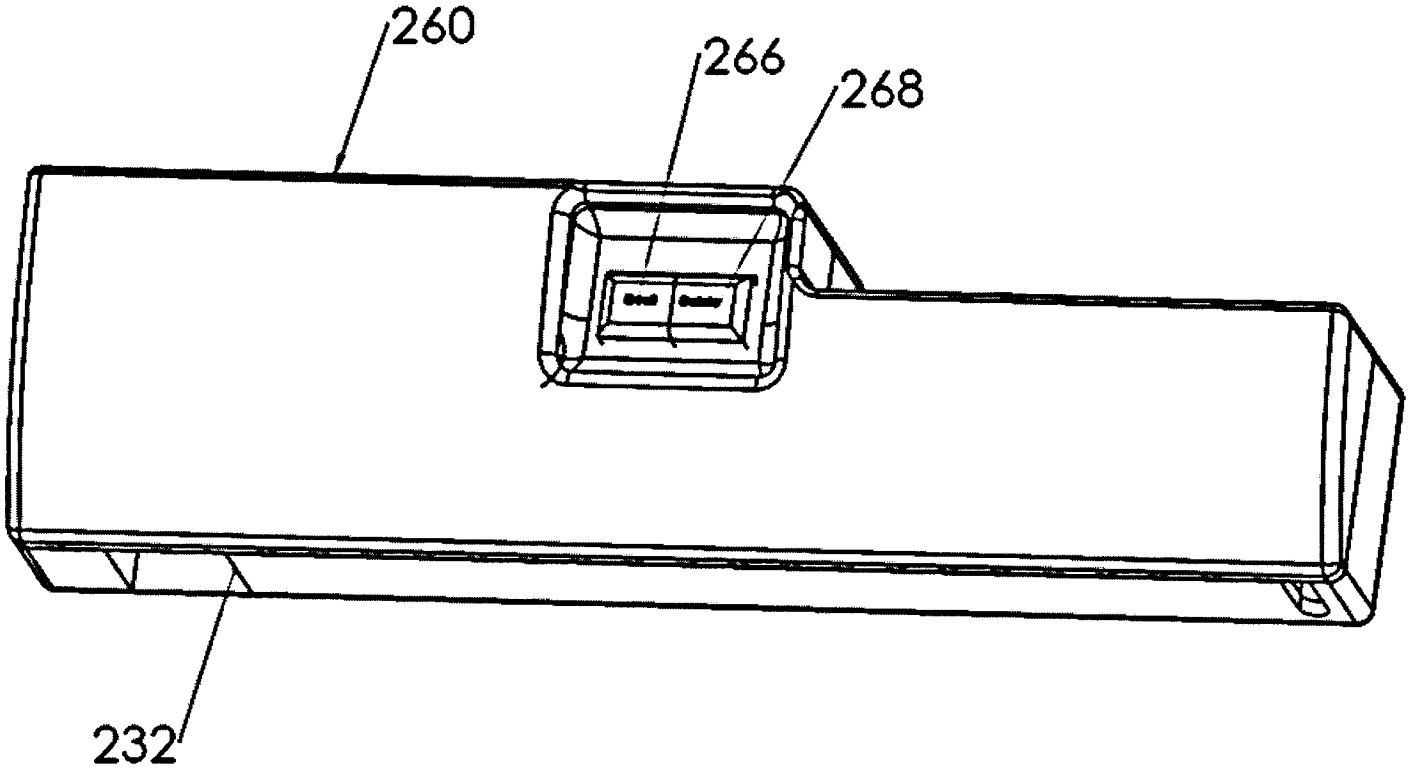
FIG. 46 is a perspective view illustrating the electronic control cartridge of the present device.
Figure 47:
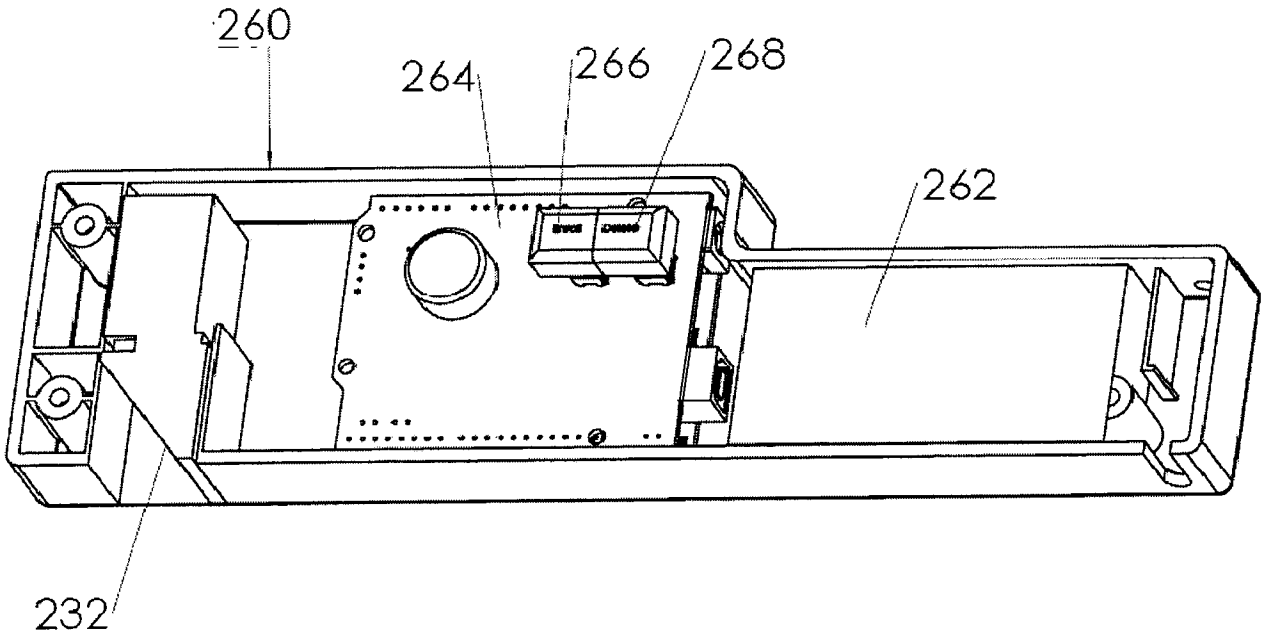
FIG. 47 is a partial perspective view illustrating the electronic control cartridge of the present device having the upper case removed.
Figure 48:
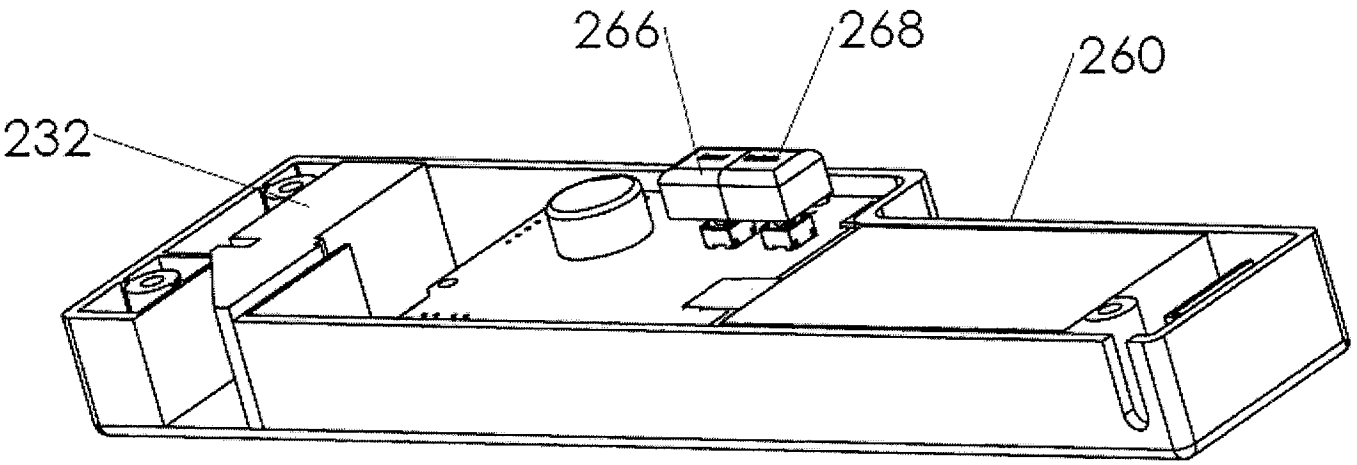
FIG. 48 is a partial perspective view illustrating the electronic control cartridge of the present device having the upper case removed.

Referring to FIGS. 46-48, one embodiment of an electronics module 260 is illustrated. The electronics module is preferably constructed from a plastic material and sized to fit within the hollow interior portion 222 of the case. The electronics module includes the biometric switch 232 for opening the electronic lock assembly which allows the access door to open. The electronics module also includes at least one battery 262 for operation of the electronics and the electronic lock assembly. Circuit board 264 is included for operation of the case and includes memory and a processor for allowing users to enter themselves into memory for biometric identification and the like. The circuit board also includes the chips required for operation of the global positioning system (GPS) and the cell phone. Buttons 266 and 268 allow the user to enter their biometrics into the memory for operation of the case.

All patents and publications mentioned in this specification are indicative of the levels of those skilled in the art to which the invention pertains. It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A firearm concealing electronic tablet case comprising: a first shell panel hingedly connected to a second shell panel, said second panel hingedly connected to a rear shell panel, said rear shell panel including a plurality of sidewalls extending substantially perpendicular with respect to said rear shell panel and away from said first and said second shell panels, a rear cover panel connecting said sidewalls to define a hollow interior portion, an access door forming a portion of said rear cover panel, said access door being hingedly connected to said rear cover panel for movement between an open and a closed position, a lock assembly for controllably preventing the release of said access door, an inside portion of said first shell panel having mounting elements for securing an electronic tablet thereto, said second shell panel contoured to cover a part of the rear portion of an electronic tablet while in a closed position having a screen portion of said electronic tablet facing a rear surface of said rear shell panel, said second shell panel having a width for use as an angle brace for supporting said electronic tablet in an angled position with respect to said rear shell panel.

2. The firearm concealing electronic tablet case of claim 1 wherein said hollow interior portion includes a support member for securing a weapon therein.

3. The firearm concealing electronic tablet case of claim 2 wherein said support member is a holster.

4. The firearm concealing electronic tablet case of claim 3 wherein said holster secures a hand gun.

5. The firearm concealing electronic tablet case of claim 1 wherein said lock assembly is an electronic lock, said hollow interior portion including at least one battery for operation of said electronic lock.

6. The firearm concealing electronic tablet case of claim 1 wherein said electronic lock is biometrically operated.

7. The firearm concealing electronic tablet case of claim 1 wherein said hollow interior portion includes a cell phone, said cell phone operable to call an emergency line upon the push of one button.

8. The firearm concealing electronic tablet case of claim 1 wherein said hollow interior portion includes a global positioning device, said global positioning device operable to send a distress call and a location upon the push of one button.

9. The firearm concealing electronic tablet case of claim 8 wherein said one button is a biometric button.

* * * * *